US006949038B2

(12) United States Patent
Fritzke

(10) Patent No.: US 6,949,038 B2
(45) Date of Patent: Sep. 27, 2005

(54) BALL BAT HAVING AN INSERT WITH VARIABLE WALL THICKNESS

(75) Inventor: Mark A. Fritzke, Portland, OR (US)

(73) Assignee: Wilson Sporting Goods Co., Chicago, IL (US)

( * ) Notice: Subject to any disclaimer, the term of this patent is extended or adjusted under 35 U.S.C. 154(b) by 11 days.

(21) Appl. No.: 10/762,024

(22) Filed: Jan. 21, 2004

(65) Prior Publication Data

US 2004/0152545 A1 Aug. 5, 2004

Related U.S. Application Data

(63) Continuation-in-part of application No. 10/033,805, filed on Dec. 28, 2001, now Pat. No. 6,733,404, which is a continuation-in-part of application No. 09/396,700, filed on Sep. 15, 1999, now Pat. No. 6,497,631.

(51) Int. Cl.[7] ..... A63B 59/06
(52) U.S. Cl. ..... 473/566; 473/567
(58) Field of Search ..... 473/564–568, 473/519, 520, 457

(56) References Cited

U.S. PATENT DOCUMENTS

| | | | | | |
|---|---|---|---|---|---|
| 1,611,858 | A | * | 12/1926 | Middlekauff | 473/566 |
| 3,963,239 | A | * | 6/1976 | Fujii | 473/519 |
| 4,331,330 | A | | 5/1982 | Worst | 273/72 |
| 4,931,247 | A | * | 6/1990 | Yeh | 264/258 |
| 5,303,917 | A | | 4/1994 | Uke | 273/72 |
| 5,364,095 | A | * | 11/1994 | Easton et al. | 473/566 |
| 5,415,398 | A | | 5/1995 | Eggiman | 273/72 |
| 5,511,777 | A | * | 4/1996 | McNeely | 473/520 |
| 5,593,158 | A | | 1/1997 | Filice et al. | 473/520 |
| 5,624,115 | A | | 4/1997 | Baum | 473/567 |
| 5,676,609 | A | | 10/1997 | Mollebeak | 473/564 |
| 5,676,610 | A | * | 10/1997 | Bhatt et al. | 473/566 |
| 5,899,823 | A | * | 5/1999 | Eggiman | 473/566 |
| 5,906,550 | A | * | 5/1999 | Kingston | 473/320 |
| 5,964,673 | A | * | 10/1999 | MacKay, Jr. | 473/566 |
| 6,042,493 | A | * | 3/2000 | Chauvin et al. | 473/566 |
| 6,152,840 | A | * | 11/2000 | Baum | 473/564 |
| 6,176,795 | B1 | * | 1/2001 | Schullstrom | 473/566 |
| 6,251,034 | B1 | | 6/2001 | Eggiman et al. | 473/567 |
| 6,344,007 | B1 | * | 2/2002 | Feeney et al. | 473/567 |
| 6,383,101 | B2 | | 5/2002 | Eggiman et al. | 473/567 |
| 6,398,675 | B1 | | 6/2002 | Eggiman et al. | 473/566 |
| 6,425,836 | B1 | * | 7/2002 | Misono et al. | 473/567 |
| 6,565,462 | B1 | * | 5/2003 | Gregg | 473/457 |
| 6,612,945 | B1 | | 9/2003 | Anderson | 473/566 |
| 6,808,464 | B1 | * | 10/2004 | Nguyen | 473/566 |
| 6,872,156 | B2 | * | 3/2005 | Ogawa et al. | 473/567 |
| 2001/0021678 | A1 | | 9/2001 | Pitsenberger et al. | 473/564 |

(Continued)

FOREIGN PATENT DOCUMENTS

| | | | | | |
|---|---|---|---|---|---|
| JP | 01110379 | A | * | 4/1989 | A63B/59/06 |
| JP | 02215481 | A | * | 8/1990 | A63B/59/06 |
| JP | 07299170 | A | * | 11/1995 | A63B/59/06 |
| JP | 10248978 | A | * | 9/1998 | A63B/59/06 |
| JP | 2004298364 | A | * | 10/2004 | A63B/59/06 |

*Primary Examiner*—Mark S. Graham
(74) *Attorney, Agent, or Firm*—Terence P. O'Brien

(57) ABSTRACT

A bat, configured for impacting a ball, includes a substantially tubular frame and a substantially tubular body. The frame extends along a longitudinal axis and has a handle portion and a primary hitting portion. The body is coaxially aligned with the hitting portion of the frame. The body includes a proximal end, a distal end, and first and second tubular wall transition regions. The wall thickness of the first tubular wall transition region generally increases along the longitudinal axis from a first position, generally near the proximal end, toward the distal end. The wall thickness of the second tubular wall transition region generally increases along the longitudinal axis from a second position, generally near the distal end, toward the proximal end. The body is configured to move independently with respect to the hitting portion of the frame upon impact with the ball.

60 Claims, 12 Drawing Sheets

U.S. PATENT DOCUMENTS

| | | | | |
|---|---|---|---|---|
| 2001/0056001 | A1 | 12/2001 | Gallagher | 473/564 |
| 2002/0016230 | A1 | 2/2002 | Okuyama et al. | 473/564 |
| 2002/0094892 | A1 | 7/2002 | Chauvin et al. | 473/566 |
| 2003/0008735 | A1 * | 1/2003 | Feeney et al. | 473/567 |
| 2003/0153416 | A1 | 8/2003 | Anderson | 473/566 |
| 2003/0186763 | A1 | 10/2003 | Eggiman et al. | 473/564 |
| 2004/0176197 | A1 * | 9/2004 | Sutherland | 473/564 |
| 2004/0209716 | A1 * | 10/2004 | Vacek et al. | 473/567 |
| 2005/0070384 | A1 * | 3/2005 | Fitzgerald et al. | 473/567 |

* cited by examiner

BALL BAT SWEET SPOT COMPARISON

BALL BAT HAVING AN INSERT WITH VARIABLE WALL THICKNESS

RELATED U.S. APPLICATION DATA

The present invention is a continuation-in-part of U.S. patent application Ser. No. 10/033,805, now U.S. Pat. No. 6,733,404 entitled "Insert For A Bat Having Improved Seam Orientation", filed on Dec. 28, 2001 by Fritzke et al., which is a continuation-in-part of U.S. patent application Ser. No. 09/396,700, entitled "Ball Bat", filed on Sep. 15, 1999 by Fritzke et al., now U.S. Pat. No. 6,497,631.

FIELD OF THE INVENTION

The present invention relates generally to baseball and softball bats. In particular, the present invention relates to an insert for a ball bat, wherein the wall thickness of the insert varies along its length.

BACKGROUND OF THE INVENTION

Ball bats, such as baseball and softball bats, are well known. In recent years, metallic bats including a tubular handle portion and a tubular hitting portion have emerged providing improved performance and improved durability over crack-prone wooden bats. The most common tubular bat is the aluminum single-wall tubular bat. Such bats have the advantage of a generally good impact response, meaning that the bat effectively transfers power to a batted ball.

Generally speaking, bat performance is a function of the weight of the bat, the size, and the impact response of the bat. The durability of a bat relates, at least in part, to its ability to resist denting and depends on the strength and stiffness of the tubular bat frame. While recent innovations in bat technology have increased performance and durability, most new bat designs typically improve performance or durability at the expense of the other because of competing design factors. For example, an attempt to increase the durability of the bat often produces an adverse effect on the bat's performance.

Another example of competing design factors concerns the bat's optimum hitting area, commonly referred to as the "sweet spot." The sweet spot is typically located near the center of the impact area of the bat. The performance of the bat typically drops off considerably when a ball impacts the bat outside the sweet spot, for example, near the end of the bat. When this occurs, the batter can feel greater vibration and less energy is transferred from the bat to the ball. An obvious way to increase the sweet spot of a bat is to increase the length and/or circumference of the bat. This option is constrained by institutional rules and regulations, as well as by the personal preferences and expectations of ball players. In addition, an increase in the overall size of the bat undesirably adds weight, often causing reduced bat speed and less slugging distance.

In the early 1990's, DeMarini Sports revolutionized the design of existing ball bats with the introduction of a multi-wall bat. The multi-wall bat comprised two tubular members (the tubular hitting portion of the bat and a second tubular member coaxially aligned with the hitting portion of the bat), wherein each tubular member is configured to move independently in response to an impact with a ball in a manner characteristic of a leaf spring. This design described in U.S. Pat. No. 5,415,398 significantly improved the impact response of the bat without adding detrimental weight or unnecessarily increasing the length or diameter of the ball bat. The disclosure of incorporated by reference U.S. Pat. No. 5,415,398 is incorporated by reference.

The incorporation of these advances, other design variations and the use of additional materials, such as, other aluminum alloys, titanium alloys and composite materials have resulted a large variety of well-performing ball bats. Despite such advances in ball bat design and materials, a continuing need exists to further improve the performance, durability and feel of existing bats.

One issue affecting high performance ball bats is the introduction of performance restrictions on ball bats by many of the Industry regulatory organizations governing organized play. Many of these organizations have imposed limitations or restrictions impose limits on the maximum responsiveness of the ball bat when impacted at the sweet spot of the ball bat. Not surprisingly, many existing bats, which were reconfigured to meet these restrictions, exhibit a significant reduction in overall bat performance due to the added weight, additional wall thickness, the lack of leaf spring independent movement between multi-walls of a ball bat, or other factors.

Thus, a continuing need exists for a ball bat, which can satisfy existing performance restrictions and provide an improved overall bat slugging performance. What is needed is a ball bat having an enlarged sweet spot providing improved bat slugging performance over a wider area of the hitting portion of the ball bat. It would be advantageous to produce a ball bat with an enlarged sweet spot without negatively affecting the reliability or durability of the ball bat. It would also be advantageous to produce a bat that meets Industry restrictions and provides optimum performance without negatively affecting the weight distribution or moment of inertial ("MOI") of the ball bat.

SUMMARY OF THE INVENTION

The present invention provides a ball bat configured for impacting a ball. The bat includes a substantially tubular frame and a substantially tubular body. The frame extends along a longitudinal axis and has a handle portion and a primary hitting portion. The body is coaxially aligned with the hitting portion of the frame. The body includes a proximal end, a distal end, and first and second tubular wall transition regions. The first tubular wall transition region is positioned closer to the proximal end than the second tubular transition region. The wall thickness of the first tubular wall transition region generally increases along the longitudinal axis from a first position, generally near the proximal end, toward the distal end. The wall thickness of the second tubular wall transition region generally increases along the longitudinal axis from a second position, generally near the distal end, toward the proximal end. The body is configured to move independently with respect to the hitting portion of the frame upon impact with the ball.

According to a principal aspect of the invention, a bat configured for impacting a ball includes a substantially tubular frame and a substantially tubular body. The frame extends along a longitudinal axis having a handle portion and a primary hitting portion. The body is coaxially aligned with the hitting portion of the frame. The body includes a proximal end, a distal end, a central region, and a distal tubular wall transition region. The distal tubular transition region is positioned near the distal end of the body. The wall thickness of the central region is generally uniform along the longitudinal axis. The wall thickness of the distal tubular wall transition region generally increases along the longitudinal axis from a first position, generally near the distal end, toward the proximal end. The body is configured to move independently with respect to the hitting portion of the frame upon impact with the ball.

The present invention also contemplates a performance-enhancing member for a ball bat. The ball bat has a substantially tubular frame, which extends along a longitudinal axis, and has a handle portion and a primary hitting portion. The bat is configured for impacting a ball. The performance-enhancing member includes a substantially tubular body, which is coaxially aligned with the hitting portion of the frame. The body includes a proximal end, a distal end, and first and second tubular wall transition regions. The first tubular wall transition region is positioned closer to the proximal end than the second tubular wall transition region. The wall thickness of the first tubular transition region generally increases along the longitudinal axis from a first position, generally near the proximal end, toward the distal end. The wall thickness of the second tubular wall generally increasing along the longitudinal axis from a second position, generally near the distal end, toward the proximal end. The body is configured to move independently with respect to the hitting portion of the frame upon impact with the ball.

According to another principal aspect of the invention, a ball bat, configured for impacting a ball, includes a substantially tubular frame, and first and second substantially tubular inserts. The tubular frame extends along a longitudinal axis having a handle portion and a primary hitting portion. Each of the first and second inserts are coaxially aligned with the hitting portion of the frame. The first insert is positioned within the second insert. Each of the first and second inserts includes a proximal end, a distal end, and first and second tubular wall transition regions. Each of the first tubular wall transition regions is positioned closer to the proximal end than each of the second tubular wall transition regions. The wall thickness of each of the first tubular wall transition regions generally increases along the longitudinal axis from a first position, generally near the proximal end, toward the distal end, and the wall thickness of each of the second tubular wall transition regions generally increases along the longitudinal axis from a second position, generally near the distal end, toward the proximal end. The first insert and the second insert are each configured to move independently with respect to the hitting portion of the frame and each other upon impact with the ball.

According to another principal aspect of the invention, a ball bat, configured for impacting a ball, includes a substantially tubular frame and a substantially tubular body. The frame extends along a longitudinal axis and has a handle portion and a primary hitting portion. The hitting portion includes a distal region, a proximal region, first and second frame wall transition regions. The first frame wall transition region is positioned closer to the proximal end than the second frame wall transition region. The wall thickness of the first frame wall transition region generally increases along the longitudinal axis from a first position, generally near the proximal region of the hitting portion, toward the distal region of the hitting portion. The wall thickness of the second frame wall transition region generally increases along the longitudinal axis from a second position, generally near the distal region of the hitting portion, toward the proximal region of the hitting portion. The body is coaxially aligned with the hitting portion of the frame. The body includes a proximal end, a distal end, and first and second tubular wall transition regions. The first tubular wall transition region is positioned closer to the proximal end than the second tubular wall transition region. The wall thickness of the first tubular wall transition region generally increases along the longitudinal axis from a first position, generally near the proximal end, toward the distal end. The wall thickness of the second tubular wall transition region generally increases along the longitudinal axis from a second position, generally near the distal end, toward the proximal end. The body is configured to move independently with respect to the hitting portion of the frame upon impact with the ball.

According to another principal aspect of the invention, a ball bat includes a substantially tubular frame and a substantially tubular body. The frame extends along a longitudinal axis having a handle portion and a primary hitting portion. The body is coaxially aligned with the hitting portion of the frame. The body includes a proximal end, a distal end and an average thickness value from the proximal end to the distal end. The wall thickness of the body varies along its length such that at least first and second separate portions of the body each have a thickness, which is greater than the average thickness, and at least third and fourth separate portions of the body each have a wall thickness which is below the average wall thickness value. The body is configured to move independently with respect to the hitting portion of the frame upon impact with the ball.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
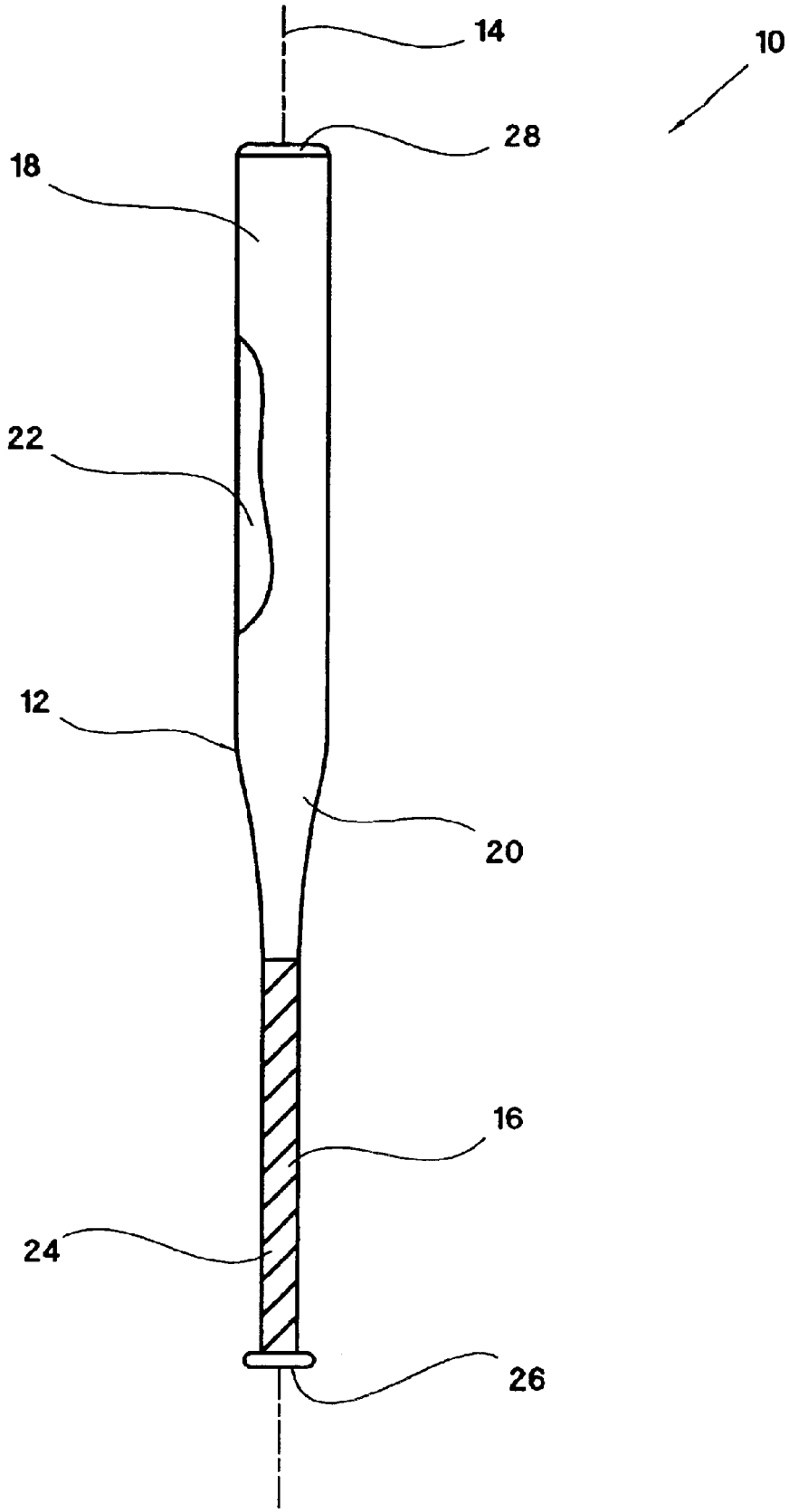
FIG. 1 is a side view of a bat in accordance with a preferred embodiment of the present invention, wherein a section of a hitting portion of a frame of the bat is removed to show an insert.

Referring to FIG. 1, a ball bat is indicated generally at 10. The ball bat 10 of FIG. 1 is configured as a softball bat;

however, the invention can also be formed as a baseball bat, a rubber ball bat, or other form of ball bat. The bat 10 includes a frame 12 extending along a longitudinal axis 14 and has a relatively small diameter handle portion 16, a relatively larger diameter hitting or impact portion 18, and an intermediate tapered portion 20 that extends between the handle and impact portions 14 and 16. In a preferred embodiment, the bat 10 further includes a tubular insert 22 coaxially aligned with the frame 12.

The tubular frame 12 is an elongate structure formed of a high tensile strength, durable material, preferably a high-grade aluminum such as C405 or C555. Alternatively, the frame 12 can be formed of other materials including other metallic alloys, a carbon-fiber composite material, a metallic fiber composite material, a fiberglass, or fiberglass other composite materials, or combinations thereof. An exemplary construction of the bat has the tubular frame 12 swaged from a constant-diameter aluminum tube to yield an integral, weld-free frame. Such swaging results in a tubular frame with thinner walls at the hitting portion 18 and thicker walls at the handle portion 16. While swaging is used to produce the tubular frame 12 of the illustrated embodiment, it should be understood that other conventional methods of manufacturing the tubular frame may be used.

In one preferred embodiment, the frame 12 is one-piece integral structure. In an alternative preferred embodiment, the handle and hitting portions 16 and 18 of the frame 12 can be formed as separate structures, which are connected or coupled together. This multi-piece frame construction enables the handle portion 16 to be formed of one material, preferably, a composite material, and the hitting portion 18 to be formed of a second, different material, such as, for example, an aluminum alloy. Other materials and material combinations may be used for the handle and hitting portions 16 and 18.

The handle portion 16 of the frame 12 is sized for gripping by the user. Preferably, the handle portion 16 includes a grip 24 wrapped around and extending longitudinally along the handle portion 16, and a knob 26 connected to a proximal end of the handle portion 16. The hitting portion 18 of the frame 12 is "tubular," "generally tubular,"or "substantially tubular," each terms intended to encompass softball style bats having a substantially cylindrical impact portion (or "barrel") as well as baseball style bats having a generally frusto-conical barrel. The hitting portion 18 is preferably configured to receive the insert 22. A distal end of the hitting portion 18 is preferably curled inward to retain the insert 22, and an end cap 28 is attached to a distal region of the hitting portion 18 to substantially enclose the distal end of the bat 10. In one particularly preferred embodiment, the frame 12 has a yield strength of approximately 85,000 psi and the hitting portion 18 has a length of approximately 13 inches long and a wall thickness of approximately 0.050 inches, and the insert 22 has a length of approximately 13.25 inches long. While such dimensions yield excellent results, it is to be understood that they are exemplary only, and that many permutations of the bat frame, insert, and gap dimensions will work equally well. All permutations fall within the scope of the present invention.

Figure 2:
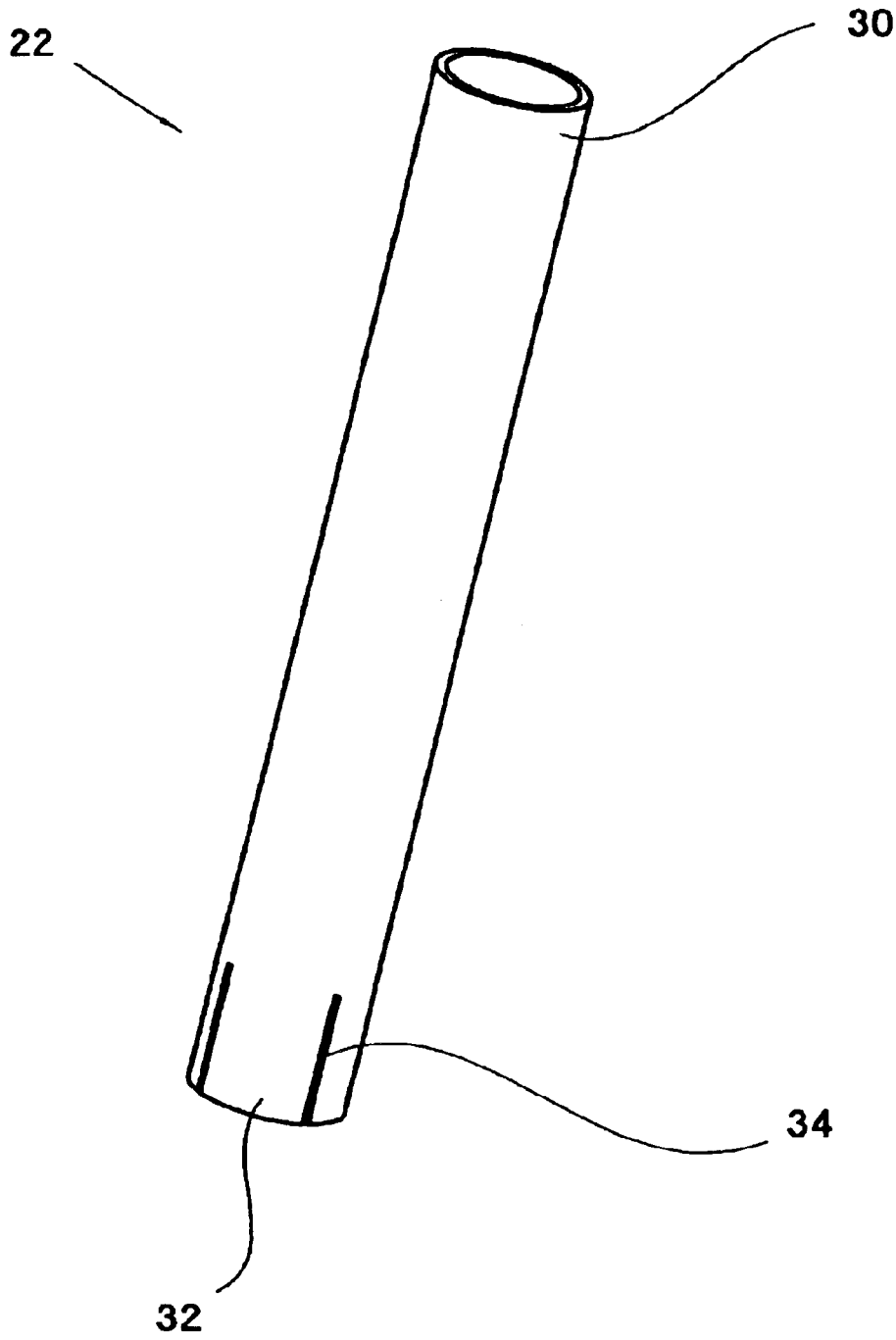
FIG. 2 is a side perspective view of the insert of FIG. 1.
Figure 3:
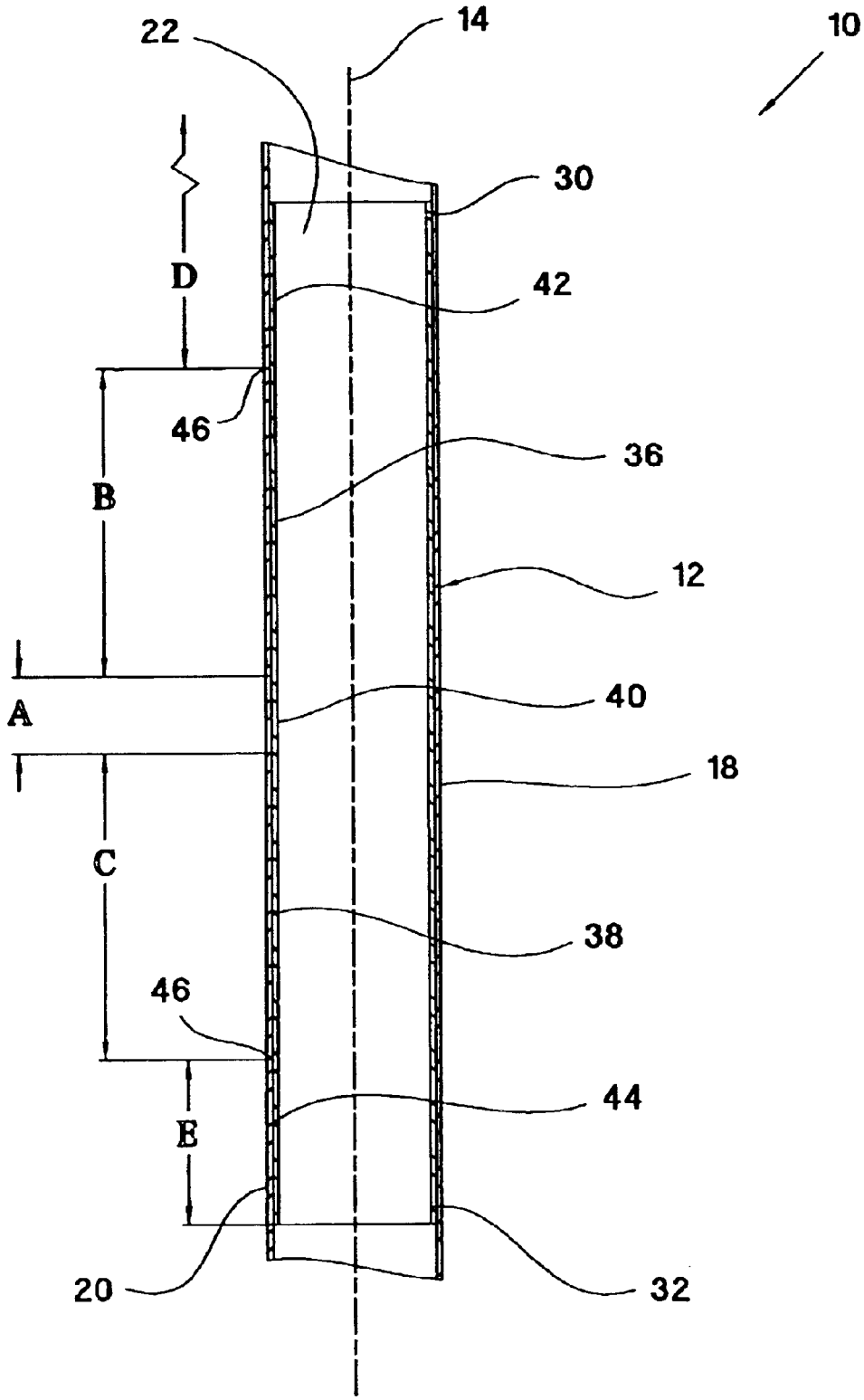
FIG. 3 is a longitudinal cross-sectional view of a portion of the bat and the insert of FIG. 1.

Referring to FIGS. 1 through 3, the insert 22 is shown in greater detail. The insert 22 is a cylindrical structure preferably sized to extend within and along a significant portion of the hitting portion 18 of the frame 12. The insert 22 has opposing distal and proximal ends 30 and 32, which preferably engage the frame 12. Such engagement inhibits axial movement of the insert 22 within the frame 12. For example, the proximal end 32 of the insert 22 can contact the intermediate tapered portion 20 of the frame 12, and the distal end 30 of the insert 22 can contact the curled distal region of the hitting portion 18 of the frame 12. In alternative preferred embodiments, the distal and proximal ends 30 and 32 of the insert 22 can be supported or fixedly coupled to the frame in other ways. For example, the distal end of the insert can be held in place by an end plug, which forms a closure for the tubular frame 11 at the end portion 32. Alternatively, the insert may be end-supported within the tubular frame 11 in other ways, such as by fasteners or an adhesive. The insert also may be compressively restrained at its ends by the hitting portion and/or the intermediate tapered portion of the bat.

The insert 22 is positioned within the frame 12 of the bat 10 such that the insert 22 is capable of moving independently with respect to the frame 12 upon impact of the bat with a ball. In one preferred embodiment, the insert 22 is formed with an outside diameter that is slightly smaller than the inside diameter of the hitting portion 18 of the frame 12. In a particularly preferred embodiment, the insert 22 has an outside diameter of approximately 2.13 inches and the hitting portion 18 of the bat has an inside diameter of approximately 2.15 inches, such that a nominal radial space of approximately 0.0010 inches can exist between the insert 22 and the frame 12. Other insert and frame dimensions are also contemplated. Further, it is understood that such a space is not necessarily uniform, that manufacturing and other design tolerances can exist in the insert and the frame. In fact, the spatial relationship between the insert and the hitting portion 18 only needs to be sufficient to allow the insert and impact portion to move substantially independent of one another upon impact. This independent movement enables the insert 22 and the frame 12 to function during use with the characteristics of a leaf spring.

The insert 22 and the hitting portion 18 of the frame 12 provide the bat 10 with two essentially parallel walls in the "hitting zone" or barrel region. The independent movement of these two walls (the leaf spring action) produces an exceptional impact response or "trampoline" effect upon impact with a ball. In a particularly preferred embodiment, grease, other lubricants or a mold release (not shown) can be disposed between the insert and the frame to facilitate such independent movement. In other alternative preferred embodiments, a filler material such as, for example, a urethane, a rubber or other elastic material may disposed between the insert and the frame, wherein the filler material enables independent movement between the insert and frame upon impact with a ball.

The insert 22 is formed of a high strength, lightweight material, preferably a heat treated aluminum alloy. Alternatively, other materials can be used, such as, for example, a titanium alloy, other metallic alloys, carbon fiber composite materials, metallic fiber composite materials, fiberglass, other composite materials, and combinations thereof. The insert 22 is preferably formed as an integral one-piece unit. Alternatively, the insert 22 can be formed from two or more separate components positioned end to end, in an overlying coaxial configuration, or a combination thereof.

In a preferred embodiment, the insert 22 includes at least one slit 34 extending beginning at the proximal end 32 and longitudinally extending in the direction the distal end 30. The slit(s) 34 enable the proximal end 32 to readily inwardly deflect as it contacts the intermediate tapering portion 20 of the bat 10. The slit(s) 34 also facilitate engagement of the proximal end 32 with the bat 10. In a particularly preferred embodiment, the insert 22 includes four spaced-apart slits 34. Each slit 34 has a length of approximately 1.0 inch and a width of approximately 0.0625 inches. Slits 34 having alternative dimensions, orientations and configurations are also contemplated. In an alternative preferred embodiment, the insert can be formed without one or more slits.

Figure 4:
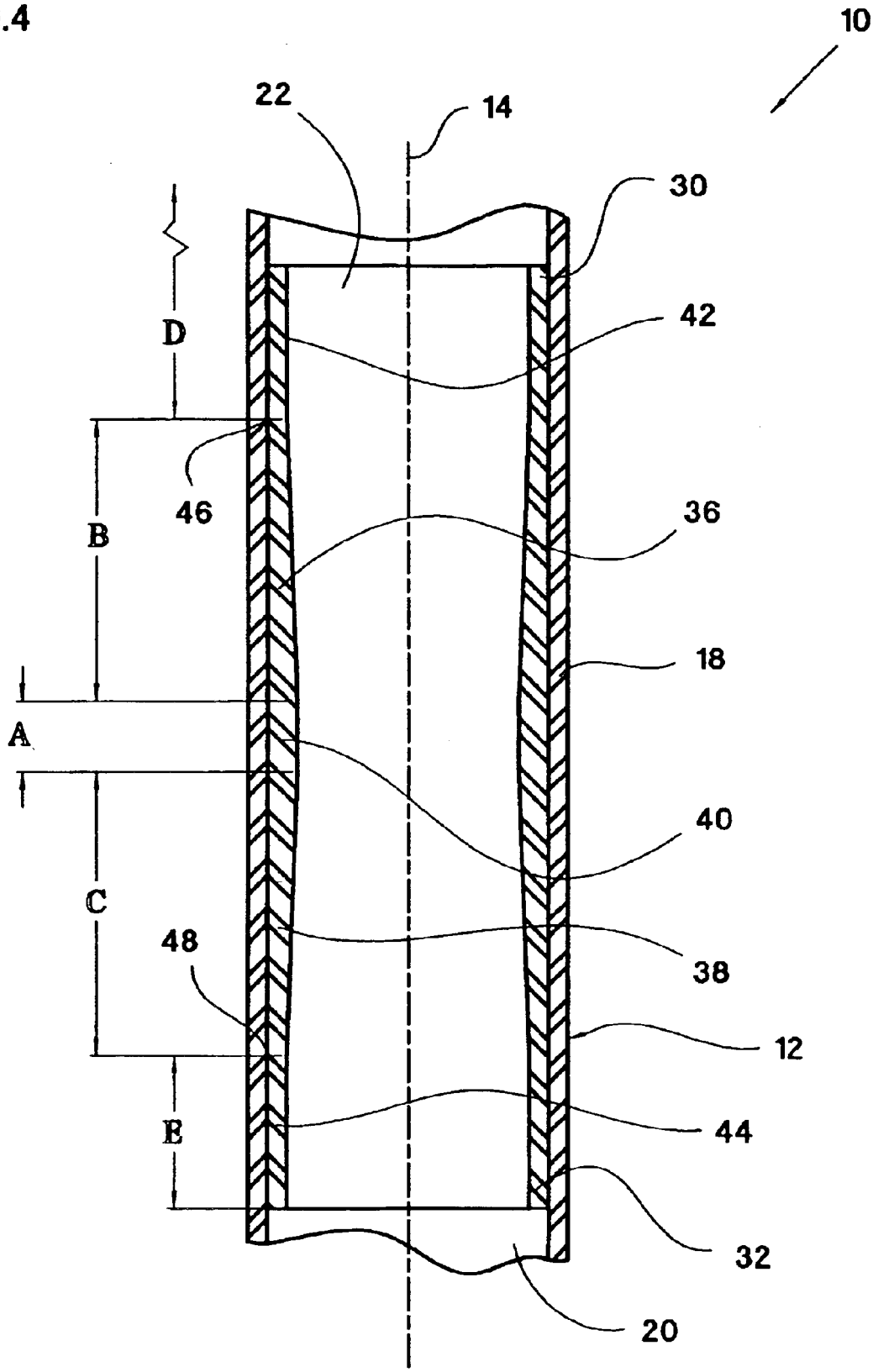
FIG. 4 is a longitudinal cross-sectional view of a portion of a bat and an insert in accordance with an alternative preferred embodiment of the present invention.

Referring to FIGS. 3 and 4, the insert 22 is shown in greater detail. In a preferred embodiment, the insert 22 includes the distal and proximal ends 30 and 32, first and second tubular wall transition regions 36 and 38, an intermediate tubular region 40, and distal and proximal tubular regions 42 and 44. The distal and proximal tubular regions 42 and 44 are positioned adjacent the distal and proximal ends 30 and 32, respectively. The intermediate tubular region 40 is positioned between the first and second tubular wall transition regions 36 and 38. The first transition region 36 is then positioned between the intermediate tubular region 40 and the distal tubular region 42, and the second transition region 38 is positioned between the intermediate tubular region 40 and the proximal tubular region 44. The insert 22 is formed with variable wall thickness. FIG. 3 illustrates one preferred embodiment of the insert 22 having variable wall thickness, and FIG. 4 illustrates another alternative preferred embodiment of the insert 22, wherein the variation in wall thickness between the regions is more pronounced (and readily visible).

The intermediate tubular region 40 is preferably positioned at the location of adjacent the most responsive section of the hitting portion 18 of the frame 12. In other words, the intermediate tubular region 40 is preferably positioned adjacent the center of the "sweet spot" of the bat. In one particularly preferred embodiment, the intermediate region 40 is centered at a location approximately 5.25 inches from the distal end 30 of the insert 22. The intermediate tubular region 40 preferably has a generally uniform wall thickness, which varies by less than or equal to 0.003 inch. The wall thickness of the insert 22 is also preferably greatest at the intermediate tubular region 40. The generally uniform wall thickness of the intermediate tubular region is within the range of 0.030 to 0.090 inch. In alternative preferred embodiments, the intermediate tubular region 40 can be formed of other thicknesses. The length of the intermediate tubular region 40 (shown as item A on FIGS. 3 and 4) is preferably within the range of 0.25 to 9.0 inches. In a particularly preferred embodiment, the length of the intermediate tubular region is within the range of 1.0 to 5.0 inches. In one particularly preferred embodiment, as shown in FIG. 3, the intermediate tubular region 40 has a wall thickness of approximately 0.056 inch and a length of approximately 1.0 inch. In yet another alternative preferred embodiment, the insert can be formed without an intermediate tubular region.

Each of the first and second tubular wall transition regions 36 and 38 has a wall thickness that varies along the longitudinal axis 14. The first transition region 36 has a wall thickness that generally increases along the axis 14 from a first position 46, closest to the distal end 30, toward the proximal end 32. The second transition region 38 is preferably similar to the first transition region, but varies in thickness in a manner that is opposite to (or symmetrical about a transverse cross-sectional plane extending through the intermediate region) the first transition region 36. In particular, the wall thickness of the second transition region 38 generally increases along the longitudinal axis 14 from a second position 48, closest to the proximal end 32, toward the distal end 30. In a preferred embodiment, as shown in FIGS. 3 and 4, the wall thickness of the first and second transition regions 36 and 38 varies generally linearly and generally uniformly along the longitudinal axis. In alternative preferred embodiments, the wall thickness of one or both of the first and second tubular wall transition regions can increase along its length in a manner that is non-linear, staggered, stepped, or a combination thereof. The variation in wall thickness of one or more of the first and second transition regions 36 and 38 along its length can vary within the range of 0.003 to 0.050 inch. Preferably, the variation in wall thickness of one or more of the first and second transition regions 36 and 38 along its length can vary within the range of 0.005 to 0.040 inch. In particularly preferred embodiments, the variation in wall thickness of one or more of the first and second transition regions 36 and 38 along its length can vary within the range of 0.005 to 0.015 inch. For example, in one particularly preferred embodiment, the wall thickness along the length of each of the first and second transition regions 36 and 38 varies by 0.006 inch, from a wall thickness of 0.048 inch at one end the transition region to a wall thickness of 0.054 inch at the other end of the transition region.

The length of each of the first and second tubular wall transition regions 36 and 38 (shown as items B and C, respectively, on FIGS. 3 and 4) is preferably within the range of 0.25 to 7.0 inches. In a preferred embodiment, the length of the first and second tubular wall transition regions 36 and 38 is within the range of 0.50 to 5.0 inches. In a particularly preferred embodiment, the length of the first and second tubular wall transition regions 36 and 38 is within the range of 2.0 to 4.0 inches. In alternative preferred embodiments, the first and second tubular wall transition regions can have the same length or varying lengths.

The distal and proximal tubular regions 42 and 44 are preferably positioned at opposite ends of the insert 22. The distal tubular region 42 is positioned at the distal end 30 and extends to the first tubular wall transition region 36, and the proximal tubular region 44 is positioned at the proximal end 32 and extends to the second tubular wall transition region 38. The distal and proximal tubular regions 42 and 44 each preferably have a generally uniform wall thickness, which varies by less than or equal to 0.003 inch along its length. The wall thickness of the insert 22 is also preferably the thinnest at at least one of the distal and proximal tubular regions 42 and 44. The generally uniform wall thickness of the distal and proximal tubular regions 42 and 44 region are within the range of 0.025 to 0.085 inch. In one particularly preferred embodiment, as shown in FIG. 3, the distal and proximal tubular regions 42 and 44 each have a wall thickness of approximately 0.048 inch. In alternative preferred embodiments, other wall thicknesses can be used, and the wall thickness can vary between the distal and proximal tubular regions 42 and 44.

The length of the distal tubular region 42 (shown as item D on FIGS. 3 and 4) is preferably within the range of 0.25 to 4.0 inches, and the length of the proximal tubular region 44 (shown as item E on FIGS. 3 and 4) is preferably within the range of 2.0 to 6.0 inches. In a particularly preferred embodiment, the length of the distal tubular region 42 is preferably within the range of 0.50 to 2.0 inches, and the length of the proximal tubular region 44 is preferably within the range of 3.0 to 5.0 inches. In one particularly preferred embodiment, the distal tubular region 42 has a length of approximately 1.25 inches and a thickness of 0.048 inch, and the proximal tubular region 44 has a length of approximately 4.0 inches and a thickness of 0.048 inch. Other lengths, other thicknesses and combinations thereof are also contemplated under this invention. In yet another alternative preferred embodiment, the insert can be formed without one or both of the distal and proximal end regions.

In a preferred embodiment the outer diameter of the insert 22 is generally uniform along its length and the inner diameter of the insert 22 varies along its length to accommodate the variations in wall thickness along the length of the insert 22. Preferably, the outer diameter of the insert 22 varies by less than 0.003 inch along the length of the insert 22, while the inner diameter varies by at least 0.005 inch along the length of the insert. By maintaining the outside diameter of the insert 22 generally uniform along its length, the space or gap between the outer surface of the insert 52 and the inner surface of the frame 12 can be more evenly distributed across the interface between the two components. The space or gap need not be continuous or uniform, but rather, needs only to be sufficient enough to enable independent movement of the insert with respect to the frame upon impact with a ball in a manner characteristic of a leaf spring. In alternative preferred embodiments, the insert can be formed with a generally uniform inner diameter along its length and an outer diameter that varies along its length to accommodate variation in wall thickness of the insert of the present invention. In another alternative preferred embodiment, both the inner and outer diameters of the insert can be varied along their length. In another alternative preferred embodiment, the insert can include a taper that conforms to the general contour of the hitting portion of the bat frame, if the hitting portion includes a tapered region.

The thickness of the insert 22 therefore is greatest near the center of the sweet spot (at the intermediate region 40) and decreases (linearly, non-linearly or incrementally) towards the distal and proximal end regions 142 and 144. Such an embodiment is advantageous because it provides the greatest thickness and strength in the area where most impacts occur, and less thickness and less weight (and hence greater flexibility) in the area where the stress is less. This design therefore behaves much like a tapered beam. As a result, less material is needed for the insert 22 and/or the hitting portion 18.

By varying the wall thickness of the insert 22 along its length in a sort of "table-top" configuration as shown in FIGS. 3 and 4, unnecessary and undesirable weight is removed from the ends of the insert. This removed weight from the insert 22 can be repositioned to other locations on the ball bat such as at the handle portion, adjacent the knob, at the knob, or simply removed altogether from the bat. The ability to reposition this unnecessary weight in the insert to another location in the bat 10 enables the bat to be optimized or tuned for a particular application or for a particular ball player. The reduced wall thickness of the insert 22, particularly toward the distal end 30 of the insert, enables the moment of inertia ("MOI") of the bat 10 to be decreased at the optimum location (the end of the bat). A bat with a lower MOI is easier to swing than a bat with a higher MOI. The reduced MOI, particularly at the distal end of the bat, enables the player to achieve greater swing speed compared to a bat with a higher MOI, thereby providing improved performance, speed and power during impact. The variable wall thickness of the insert along its length allows for the efficiency of the bat's weight to be maximized and for the flexibility of the bat to be optimized along the barrel (or its hitting portion 18) without reducing the durability and reliability of the bat.

The variable wall thickness of the insert along its length also significantly increases the size of the bat's sweet spot. This increase in the size of the sweet spot is evident in the following example. Two ball bats were tested by an independent ball bat test facility, an approved test laboratory of the Amateur Softball Association ("ASA"). Each of the bats was tested in accordance with the ASA Bat Performance Standards and ASTM Standard No. F 2219 entitled "Measuring High Speed Baseball and Softball Bat Performance. The ball bat tests included measurements of the coefficient of restitution ("COR") of a ball bat at different impact locations along the hitting portion of the bat. COR is a measure of impact efficiency calculated as the relative speed of a batted ball after impact divided by the relative speed of the ball before impact. BB COR is the COR of a specific ball colliding with a bat as defined in the test method of the ASA Bat Performance Standards and ASTM Std. No. F2219. In particular, the BB COR measurements were taken at the center of percussion ("COP") of each ball bat and at positions one and two inches on either side of the COP. The COP is also known as the center of oscillation, the length of a simple pendulum with the same period as a physical pendulum, as in a bat oscillating on a pivot.

Figure 5:
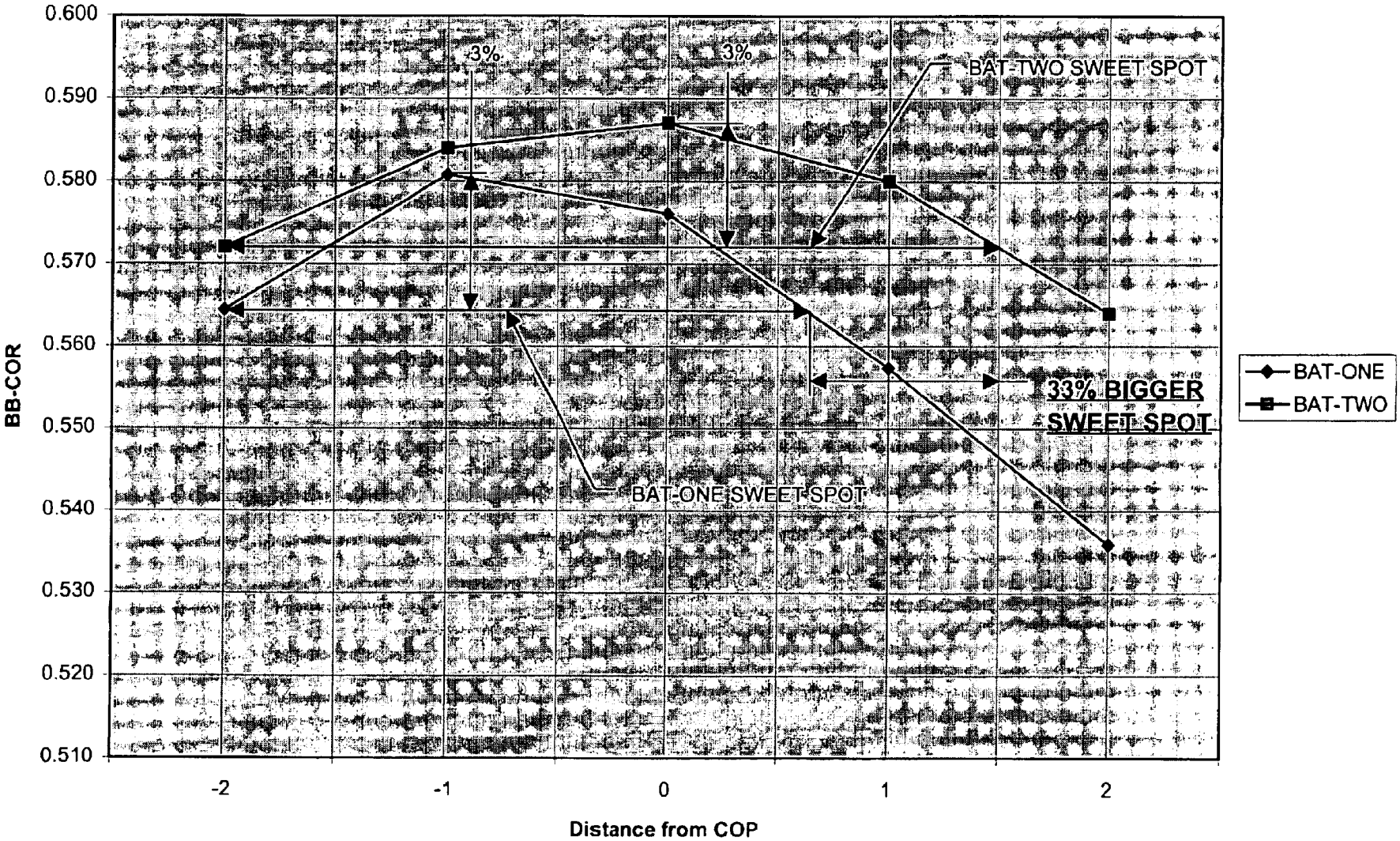
FIG. 5 is a graphical representation of the ball bat coefficient of restitution in relation to the center of percussion for two ball bats.

Referring to FIG. 5, a graph of the test data obtained from the two bats tested is illustrated. The two bats are softball bats each having a barrel diameter of 2.25 inches and a weight of 34 ounces. Each of the bats includes a handle portion formed of a composite material, a barrel (or hitting portion) formed of an aluminum alloy, and an insert also formed of an aluminum alloy. The insert of each bat is coaxially aligned within the hitting portion the bat's frame. The insert of the first bat ("BAT-ONE") has a uniform wall thickness of 0.054 inch along its length, and is configured to move independently of the hitting portion of the bat upon impact with a ball. The second bat ("BAT-TWO") includes an insert having a wall thickness that varies over its length, such as the table-top configuration of FIGS. 3 and 4 above. In particular, the insert of the BAT-TWO includes an intermediate tubular region having a wall thickness of 0.056 inch and a length of 4.0 inches, a distal and proximal end regions having a thickness of 0.048 inch, and first and second tubular wall transition regions each having a wall thickness that varied linearly along its length from a thickness of 0.056 inches at the intermediate tubular region to a thickness of 0.048 inches away from the intermediate tubular region.

FIG. 5 illustrates BB COR measurements for the BAT-ONE and BAT-TWO ball bats recorded from ball impact locations at and adjacent to the COP of the ball bat. FIG. 5 also includes a line or curve connecting the BB COR measurements for each ball bat. For the purposes of this Example, the size of the sweet spot of a bat is determined from the highest measured BB COR value and from locations on the graphical line or curve which are 3% below the highest measured BB COR value.

As seen from FIG. 5, the sweet spot of the BAT-ONE is bounded by a location 2 inches proximal of the COP of the BAT-ONE bat to a location approximately 0.6 inch distal of the COP. Additionally, the highest BB COR value recorded for the BAT-ONE bat was 0.581. In contrast, the BAT-TWO ball bat, incorporating the insert of the present invention, exhibited a sweet spot extending from a location 2 inches proximal of the COP of the BAT-TWO ball bat to a location 1.5 inches distal of the COP. Further, the BAT-TWO recorded a maximum BB COR of 0.587. Accordingly, a comparison of the sizes of the sweet spots of the two ball bats from FIG. 5 illustrates that the size of the sweet spot of the BAT-TWO ball bat is approximately 33% greater than the sweet spot of the BAT-ONE ball bat.

It is noted that the size of the sweet spot of a ball bat can be affected by a number of factors including the material composition of the bat, the size of the barrel and the weight of the bat. In this example, however, the material composition, barrel size and bat weights of the BAT-ONE and BAT-TWO ball bats were essentially the same. The only substantive difference between the two bat models was the insert configurations of the ball bats.

Accordingly, the test data of FIG. 5 reasonable demonstrates that the insert configuration of the BAT-TWO is a significant factor contributing to the 33% increase in the size of the sweet spot. Further, the insert configuration of the present invention resulted in an increase in the maximum BB COR value of the ball bat.

Importantly, in the context of the present regulatory environment for ball bats, where limitations have been placed on the maximum batted ball speed and maximum impact response of a ball bat by most baseball and softball organizations governing organized play, a need exists for a bat that performs at or below these values but also can provide additional performance benefits. Here, the present invention enables the ball bat to meet existing regulatory limits on bat maximum bat performance but also enables the performance of the ball bat to be significantly increased at locations away from the center of the sweet spot or the COP. Accordingly, a ball bat of the present invention can provide improved bat performance particularly for impact occurring at location away from the center of the sweet spot. Moreover, the performance of a ball bat of the present invention can be tuned or optimized along the length of its barrel (or hitting position 18) by varying the wall thickness of the bat along the barrel. Such optimization enables a bat to be configured for a particular size, weight, or material of a bat, or a particular application, ball, or player.

Figure 6:
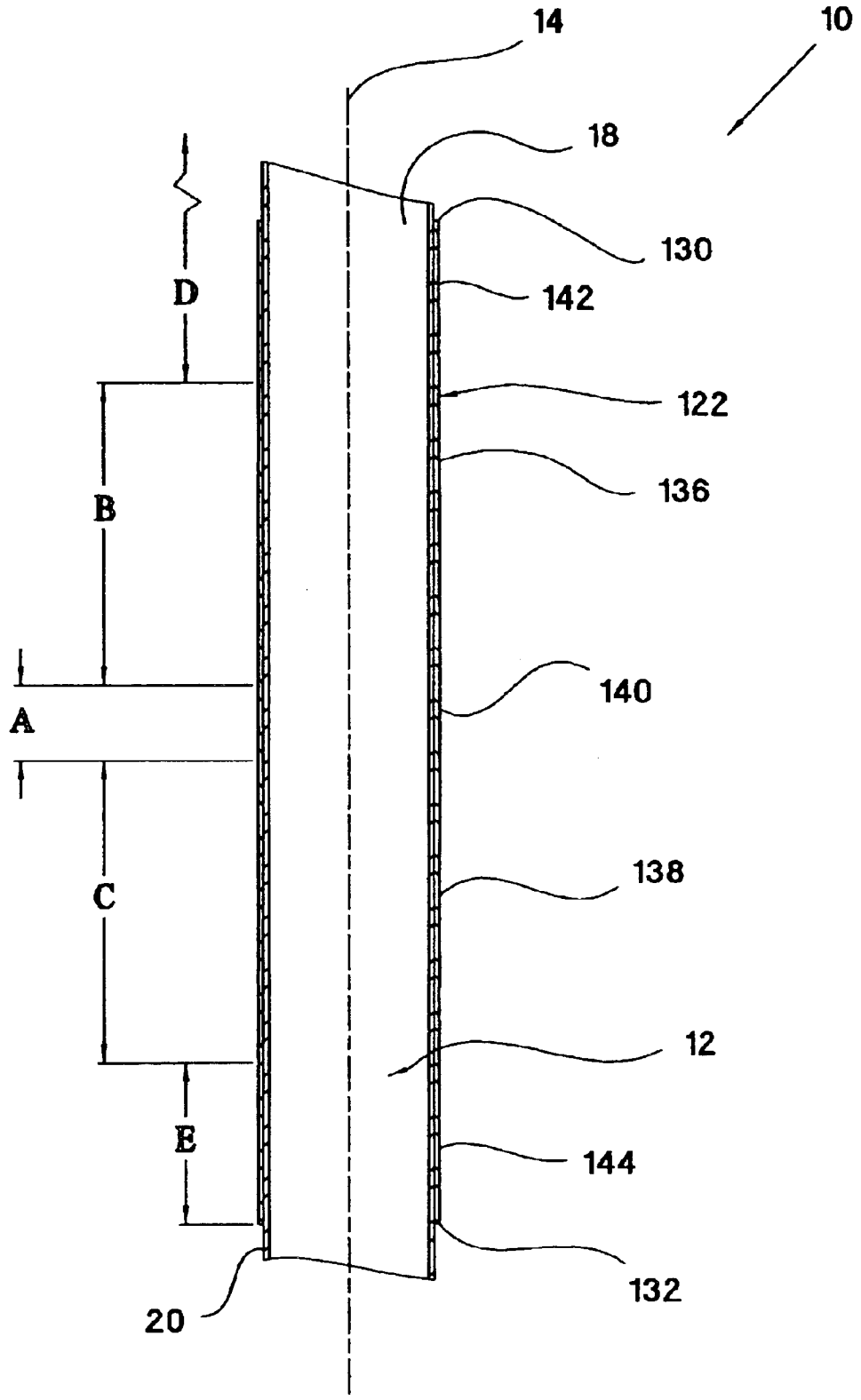
FIG. 6 is a longitudinal cross-sectional view of a portion of a bat and an insert in accordance with another alternative preferred embodiment of the present invention.
Figure 7:
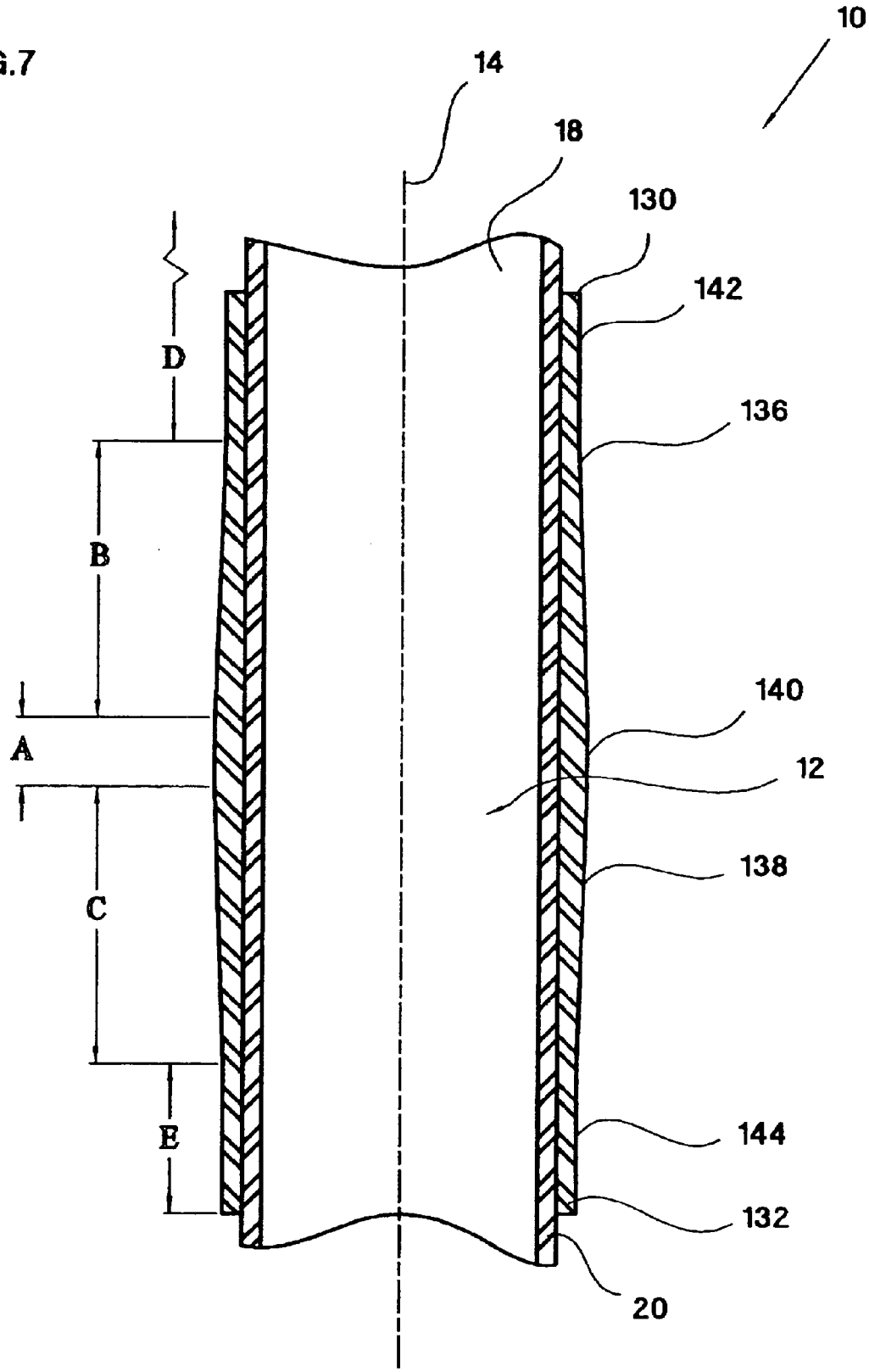
FIG. 7 is a longitudinal cross-sectional view of a portion of a bat and an insert in accordance with another alternative preferred embodiment of the present invention.

Referring to FIGS. 6 and 7, an alternative preferred embodiment of the present invention is illustrated. In this embodiment, a tubular member 122, substantially similar to the insert 22, is positioned in an overlying coaxial relationship with the hitting portion 18 of the frame 12 of the ball bat 10. Due to its position on the exterior of the bat 10, the tubular member 122 is not an insert but rather is more of an "exert" or an "outsert." The tubular member 122 assumes the role of the impact portion (hitting portion) forming the outer wall of the bat, and the hitting portion 18 assumes the role of the insert from the previous embodiment forming the inner wall of th bat. FIG. 6 illustrates one preferred embodiment of the tubular member 122 having variable wall thickness, and FIG. 7 illustrates another alternative preferred embodiment of the insert 22, wherein the variation in wall thickness between the regions is more pronounced (and readily visible).

Similar to the insert 22, the tubular member 122 includes distal and proximal ends 130 and 132, first and second tubular wall transition regions 136 and 138, an intermediate tubular region 140, and distal and proximal tubular regions 142 and 144. Each of these regions are configured to be substantially similar to the corresponding regions of the insert 22 described above, including the lengths and wall thicknesses discussed above. The outer and inner diameters of the tubular member 122 are larger than the outer and inner diameters of the insert 22 to enable the tubular member 122 to be coaxially aligned on the outer surface of the hitting portion 18 of the frame 12. The tubular member 122 is configured to move independently with respect to the hitting portion 18 of the frame upon impact with a ball in a manner characteristic of a leaf spring. As such, the tubular member 122 is configured to provide substantially similar multi-wall performance characteristics as the insert 22.

In order to maintain a generally even distribution of space, or gap between the tubular member 122 and the outer surface of the hitting portion 18 of the frame 12, the inner diameter of the tubular member 122 is generally uniform along it's length. The outer diameter of the tubular member 122 then varies along the length of the tubular member 122 in order to accommodate the variations in wall thickness of the tubular member 122 along each of the regions. The space or gap need not be continuous but rather need only be sufficient to all for independent movement of the tubular member 122 and the hitting portion 18 upon impact with a ball. The tubular member 122 is configured to provide similar performance benefits to the bat 10 as provided by the insert 22. In an alternative preferred embodiment, the inner diameter of the tubular member and the outer diameter of the hitting region of the bat may vary along their lengths and vary in a corresponding manner to accommodate a taper in the bat.

Figure 8:
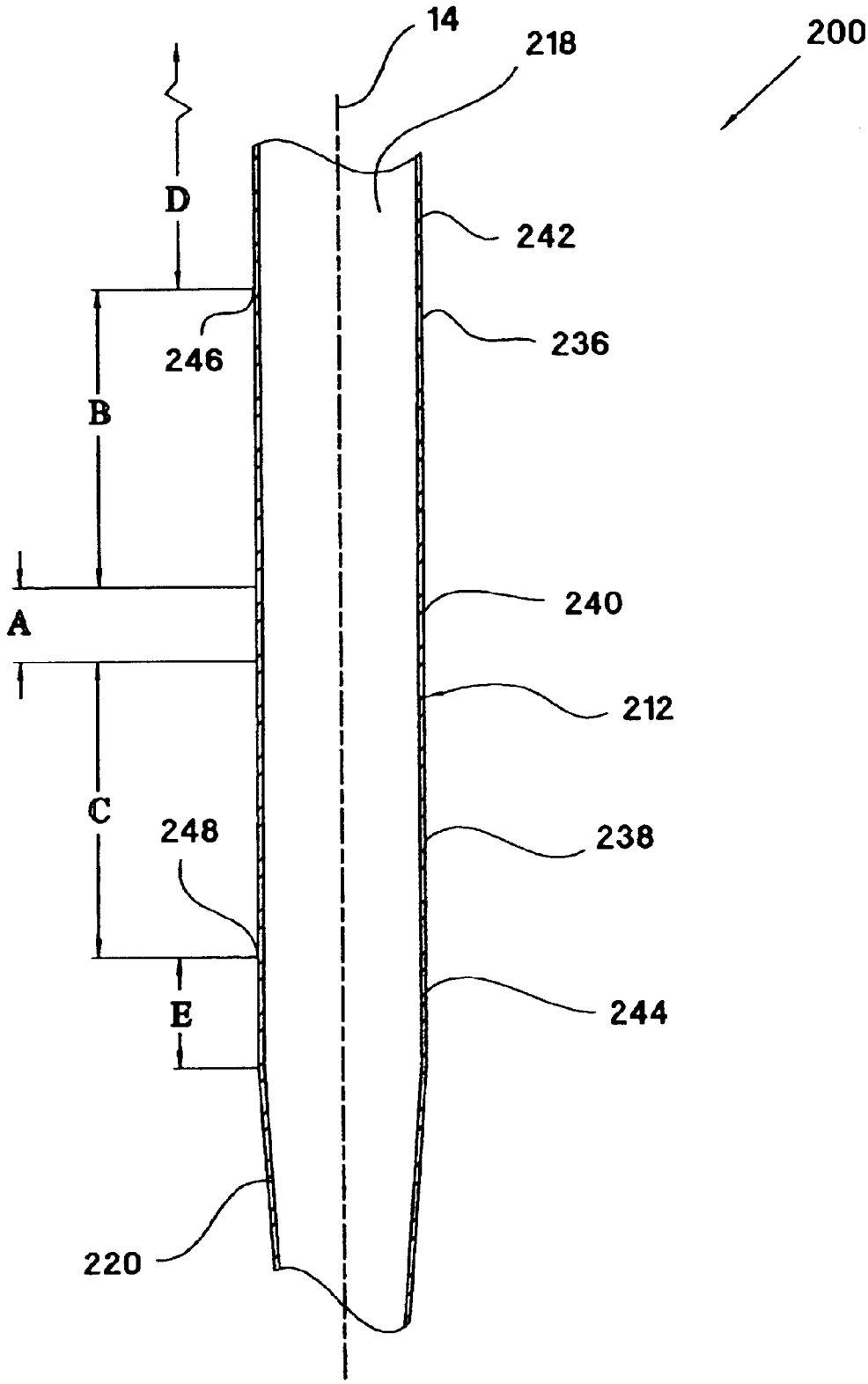
FIG. 8 is a longitudinal cross-sectional view of a portion of a bat and an insert in accordance with another alternative preferred embodiment of the present invention.
Figure 9:
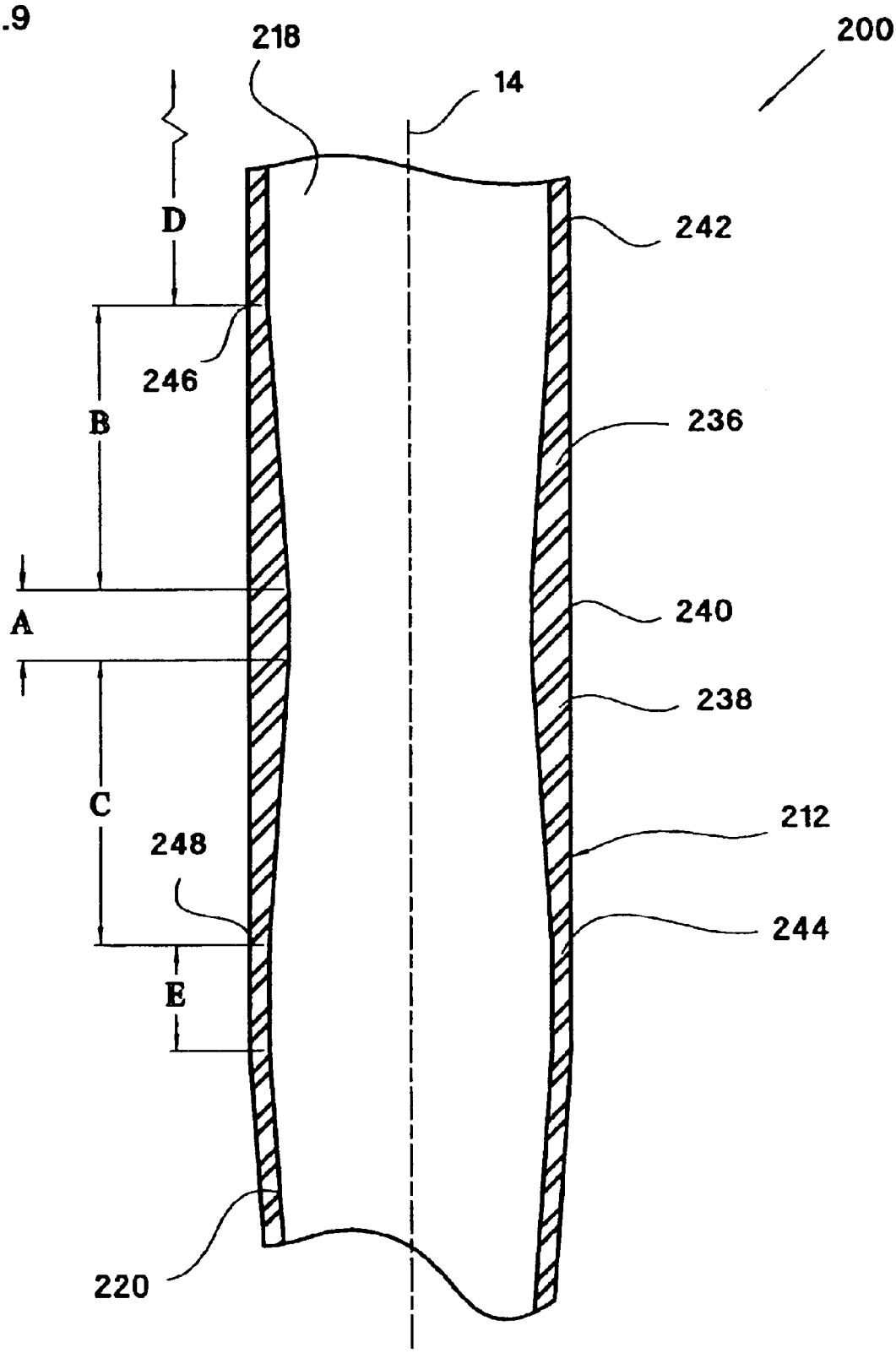
FIG. 9 is a longitudinal cross-sectional view of a portion of a bat and an insert in accordance with another alternative preferred embodiment of the present invention.

Referring to FIGS. 8 and 9, another alternative preferred embodiment of the present invention is illustrated. In this alternative preferred embodiment, a bat 200 including a frame 212 having a handle portion (not shown), a hitting portion 218 and a intermediate portion 220 between the handle and hitting portions is illustrated. The bat 200 is formed without an insert coaxially aligned with the hitting portion 218 of the frame 212. Rather, the hitting portion 218 of the bat 200 has a single-wall construction, wherein the wall thickness of the hitting portion 218 varies longitudinally along its length. With the exception of the varied wall thickness of the hitting portion 218, the frame 212 of the bat 200 is substantially similar to the frame 12 of the bat 10 described above. FIG. 8 illustrates one preferred embodiment of the bat 200 having variable wall thickness, and FIG. 9 illustrates another alternative preferred embodiment of the bat 200, wherein the variation in wall thickness between the regions of the hitting portion 218 is more pronounced (and readily visible).

The hitting portion 218 of the bat 200 includes first and second tubular wall transition regions 236 and 238, an intermediate tubular region 240, and distal and proximal tubular regions 242 and 244. The distal and proximal tubular regions 242 and 244 positioned adjacent a distal end of the bat 200 and the intermediate portion 220 of the frame 212, respectively. The intermediate tubular region 240 is positioned between the first and second tubular wall transition regions 236 and 238. The first transition region 236 is then positioned between the intermediate tubular region 240 and the distal tubular region 242, and the second transition region 238 is positioned between the intermediate tubular region 240 and the proximal tubular region 244.

The intermediate tubular region 240 is preferably centered about the sweet spot of the bat. The intermediate tubular region 240 preferably has a generally uniform wall thickness, which varies by less than or equal to 0.003 inch. The wall thickness of the hitting portion 218 is also preferably greatest at the intermediate tubular region 240. The generally uniform wall thickness of the intermediate tubular region 240 is within the range of 0.055 to 0.120 inch. In alternative preferred embodiments, the intermediate tubular region 240 can be formed of other thicknesses. The length of the intermediate tubular region 240 (shown as item A on FIGS. 8 and 9) is preferably within the range of 0.25 to 9.0 inches. In a particularly preferred embodiment, the length of the intermediate tubular region 240 is within the range of 1.0 to 5.0 inches. In one particularly preferred embodiment, as shown in FIG. 8, the intermediate tubular region 240 has a wall thickness of approximately 0.076 inch and a length of approximately 1.0 inch. In yet another alternative preferred embodiment, the hitting region can be formed without an intermediate tubular region.

Each of the first and second tubular wall transition regions 236 and 238 has a wall thickness that varies along the longitudinal axis 14. The first transition region 236 has a wall thickness that generally increases along the axis 14 from a first position 246, closest to the distal end of the bat 200, toward the handle portion. The second transition region 238 is preferably similar to the first transition region 236, but varies in thickness in a manner that is opposite, or symmetrical to, the first transition region 236. In particular, the wall thickness of the second transition region 238 generally increases along the longitudinal axis 14 from a second position 248, closest to the handle portion, toward the distal end 30. In a preferred embodiment, as shown in FIGS. 8 and 9, the wall thickness of the first and second transition regions 236 and 238 varies generally linearly and generally uniformly along the longitudinal axis 14. In alternative preferred embodiments, the wall thickness of one or both of the first and second tubular wall transition regions can increase along its length in a manner that is non-linear, staggered, stepped, or a combination thereof. The variation in wall thickness of one or more of the first and second transition regions 236 and 238 along its length can vary within the range of 0.003 to 0.050 inch. Preferably, the variation in wall thickness of one or more of the first and second transition regions 236 and 238 along its length can vary within the range of 0.005 to 0.040 inch. In particularly preferred embodiments, the variation in wall thickness of one or more of the first and second transition regions 236 and 238 along its length can vary within the range of 0.005 to 0.015 inch. For example, in one particularly preferred embodiment, the wall thickness along the length of each of the first and second transition regions 236 and 238 varies by 0.008 inch, from a wall thickness of 0.068 inch at one end the transition region to a wall thickness of 0.076 inch at the other end of the transition region.

The length of each of the first and second tubular wall transition regions 236 and 238 (shown as items B and C, respectively, on FIGS. 8 and 9) is preferably within the range of 0.25 to 7.0 inches. In a preferred embodiment, the length of the first and second tubular wall transition regions 236 and 238 is within the range of 0.25 to 5.0 inches. In a particularly preferred embodiment, the length of the first and second tubular wall transition regions 236 and 238 is within the range of 2.0 to 4.0 inches. In alternative preferred embodiments, the first and second tubular wall transition regions can have the same length or varying lengths.

The distal and proximal tubular regions 242 and 244 are preferably positioned at opposite ends of the hitting portion 218. The distal tubular region 242 is positioned at the distal end of the bat 200 and extends to the first tubular wall transition region 236, and the proximal tubular region 244 is positioned at the intermediate portion 220 of the frame 212 and extends to the second tubular wall transition region 238. The distal and proximal tubular regions 242 and 244 each preferably have a generally uniform wall thickness, which varies by less than or equal to 0.003 inch along its length. The generally uniform wall thickness of the distal and proximal tubular regions 242 and 244 region are within the range of 0.045 to 0.105 inch. In one particularly preferred embodiment, as shown in FIG. 3, the distal and proximal tubular regions 242 and 244 each have a wall thickness of approximately 0.068 inch. In alternative preferred embodiments, other wall thicknesses can be used, and the wall thickness can vary between the distal and proximal tubular regions 242 and 244.

The length of the distal tubular region 242 (shown as item D on FIGS. 8 and 9) is preferably within the range of 0.25 to 4.0 inches, and the length of the proximal tubular region 244 (shown as item E on FIGS. 8 and 9) is preferably within the range of 2.0 to 6.0 inches. In a particularly preferred embodiment, the length of the distal tubular region 242 is preferably within the range of 0.50 to 4.0 inches, and the length of the proximal tubular region 244 is preferably within the range of 3.0 to 7.0 inches. In one particularly preferred embodiment, the distal tubular region 242 has a length of approximately 2.50 inches and a thickness of 0.068 inch, and the proximal tubular region 244 has a length of approximately 3.5 inches and a thickness of 0.068 inch. Other lengths, other thicknesses and combinations thereof are also contemplated under this invention.

In this single wall configuration, the intermediate portion of the frame 220 may also include a wall thickness, which varies along its length. The variable wall thickness enables the flexibility of the bat to be adjusted. The wall thickness of the intermediate portion 220 of the bat frame 212 can fall within the range of 0.050 to 0.250 inch. Preferably the wall thickness of the intermediate portion 220 varies along its length from the hitting portion 218 toward the handle portion. The wall thickness variation can be an increase, a decrease, or increase and decrease in wall thickness along the length of the intermediate portion 220. This variation in wall thickness can be linear, non-linear, staggered, stepped, or a combination thereof. The specific wall thickness profile selected depends upon the application, the material, and the length of the bat, as well as the type of ball to be used and the player. In one particularly preferred embodiment, the wall thickness varied along its length from a value of 0.067 to 0.200 inch from a distal end of the intermediate portion 220 to a proximal end of the intermediate portion 220. In another particularly preferred embodiment, the wall thickness of the intermediate portion 220 varied along its length from a value of 0.110 inch at a distal end of the intermediate portion 220 to a value of 0.132 inch as a mid-position of the intermediate portion 220 and then to 0.077 inch at a proximal end of the intermediate portion 220. Other wall thicknesses and variations in wall thickness are also contemplated under the present embodiment.

In yet another alternative preferred embodiment, the hitting portion can be formed with one or more additional tubular wall transition regions and/or one or more additional intermediate regions. For example the ball bat could include a third tubular wall transition region positioned at a location distal of the distal end portion and or the first tubular wall transition portion, wherein the third tubular wall transition region increases in wall thickness along its length toward the distal end of the ball bat.

In another alternative preferred embodiment, the additional wall thickness can be used at the distal end of the bat to add strength or weight to the distal end of the bat, and to provide additional support for an end cap. The wall thickness of the hitting portion 218 can be varied to compensate for the stiffness and/or softness of the end cap being used as well as for the tapered ends of the bat frame. The tapers of the intermediate region 220 of the bat and any curling which may be formed into the distal end of the bat frame 212 further stiffens the bat frame. Therefore, the wall thickness can be adjusted to further optimize bat performance in light of a taper or a curled end.

In a preferred embodiment the outer diameter of the hitting portion 218 is generally uniform along its length and the inner diameter of the hitting portion 218 varies along its length to accommodate the variations in wall thickness along the length of the hitting portion 218. In alternative preferred embodiments, the insert can be formed with a generally uniform inner diameter along its length and an outer diameter that varies along its length to accommodate variation in wall thickness of the insert of the present invention. In another alternative preferred embodiment, both the inner and outer diameters of the insert can be varied along their length. In another alternative preferred embodiment, the inner and/or outer diameters of the hitting portion may vary along their length to accommodate a taper formed into the shape of the bat.

This embodiment enables the wall thickness of the hitting portion 218 to be tailored or tuned to a specific application, ball-type or player. Further, the wall thickness can be matched to other factors such as the barrel length, the bat weight, and the material selected to optimize flex within the strength of the material of the bat across the entire length of the barrel (or hitting portion 218). The bat's performance can be tuned along the barrel (the hitting portion 218) of the bat, thereby enabling the bat to be configured to meet performance requirements of regulatory organizations in organized softball and baseball, as well as maximize the size of the sweet spot. Like the multi-wall embodiments described above, the present embodiment enables the MOI of the bat, particularly at the distal end of the bat, to be reduced thereby enabling the player to increase his or her swing speed. The present embodiment results in an enlarged sweet spot and improves the performance of the bat beyond that of conventional single-wall bats.

Figure 10:
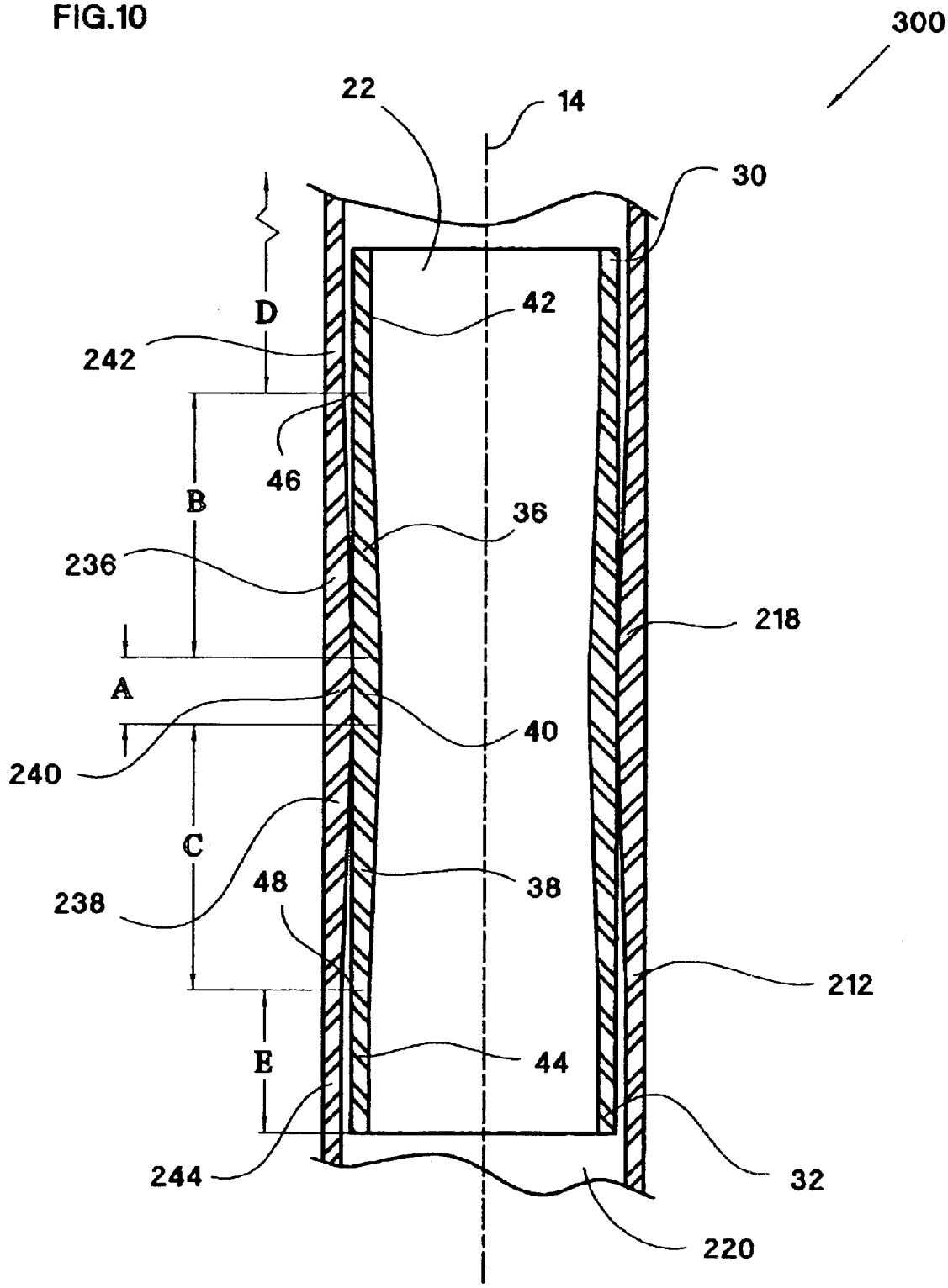
FIG. 10 is a longitudinal cross-sectional view of a portion of a bat and an insert in accordance with another alternative preferred embodiment of the present invention.

Referring to FIG. 10, another alternative preferred embodiment of the present invention a ball bat 300 is illustrated in an exaggerated or pronounced form such that the variations in wall thickness are readily visible. The ball bat 300 includes the frame 212 and the insert 22. The insert 22 is preferably positioned within the frame 212 in a manner substantially similar to position of the insert 22 in the frame 12. Preferably, the outside diameter of each of the hitting portion 218 and the insert 22 is generally uniform along its length and the inside diameter varies along its length. In this embodiment, the insert 22 remains configured to move independently of the hitting portion 218 upon impact with a ball and sufficient space remains between the hitting portion 218 and the insert 22 to enable such independent movement. In one particularly preferred embodiment, the wall thickness of the intermediate region 240 is greater than the wall thickness of the one or both of the distal and proximal tubular regions 242 and 244 by 0.006 inches. In this particularly preferred embodiment, the nominal radial space between the outside diameter of the insert 22 and the inside diameter of the hitting portion 218 at one or both of the distal and proximal tubular regions 242 and 244 is approximately 0.010 inches and the nominal radial space between the outside diameter of the insert 22 and the intermediate tubular region 240 is approximately 0.004 inches. In other particularly preferred embodiments the variation in wall thickness, and the variation in the space existing, between the insert 22 and the hitting portion 218 can vary be configured in numerous different combinations. Contact may exist at various points or regions between the insert 22 and the hitting portion 218 provided that the insert 22 remains capable of moving independently of the hitting portion 218 upon impact with a ball in a manner which is characteristic of a leaf spring. This variable wall configuration provides benefits similar to the preferred embodiments discussed above. A lubricant or other friction reducing material may be disposed between the hitting portion 218 and the insert 22. In alternative preferred embodiments, the variable thickness of one or both of the insert and the hitting portion can vary inwardly, outwardly, or a combination thereof.

Figure 11:
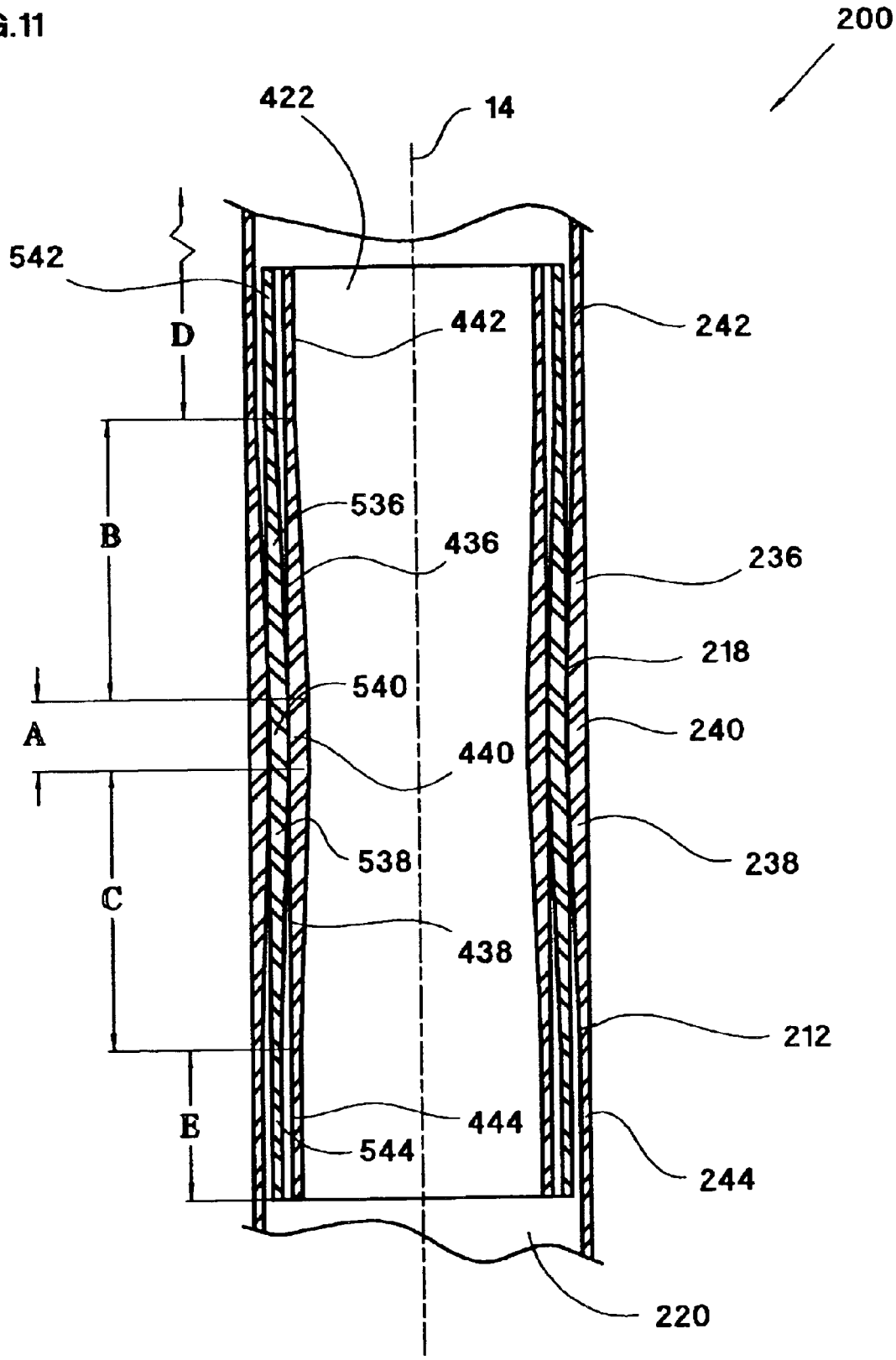
FIG. 11 is a longitudinal cross-sectional view of a portion of a bat and multiple inserts in accordance with another alternative preferred embodiment of the present invention.

Referring to FIG. 11, another alternative preferred embodiment of the present invention is illustrated. In this alternative preferred embodiment, the insert is a multi-piece insert wherein an innermost insert 422 is coaxially positioned within an intermediate insert 522, and both inserts 422 and 522 are positioned with the hitting portion 218 of the bat 200. The hitting portion 218, and the inserts 422 and 522 are shown in an exaggerated manner in order to render the variation in wall thickness of the hitting portion 218, and the inserts 422 and 522 readily visible. The inserts 422 and 522 are substantially similar to the insert 22 and can include an intermediate tubular region 440 and 540, first and second tubular wall transitions regions 436, 536 and 438, 538, and distal and proximal tubular regions 442, 542 and 444, 544. Although, generally, the nominal or average wall thickness of the inserts 422 and 522 is preferably thinner than the single insert 22. Preferably, the outside diameter of each of the hitting portion 218, the innermost insert 422 and the intermediate insert 522 is generally uniform while the inside diameter of each of the hitting portion 218, the innermost insert 422 and the intermediate insert 522 varies along its length. Each of the hitting portion 219, the inner most insert 422 and the intermediate insert 522 are positioned and configured to move independently with respect to each other upon impact with a ball in a manner characteristic of a leaf spring. The surfaces of the hitting portion 218, and the inserts 422 and 522 may contact each other provided that sufficient space exists to enable independent movement between the hitting portion 218 and the inserts 422 and 522. This variable wall configuration provides benefits similar to the preferred embodiments discussed above.

A lubricant or other friction reducing material may be disposed between one or more of the hitting portion 218, the innermost insert 422, and the intermediate insert 522. In other alternative preferred embodiments, three or more inserts can be used in lieu of the inserts 422 and 522. In still other alternative preferred embodiments, the variable thickness of one or more of the innermost insert 422, the intermediate insert 522, and the hitting portion can vary inwardly, outwardly, or in any combination thereof.

Figure 12:
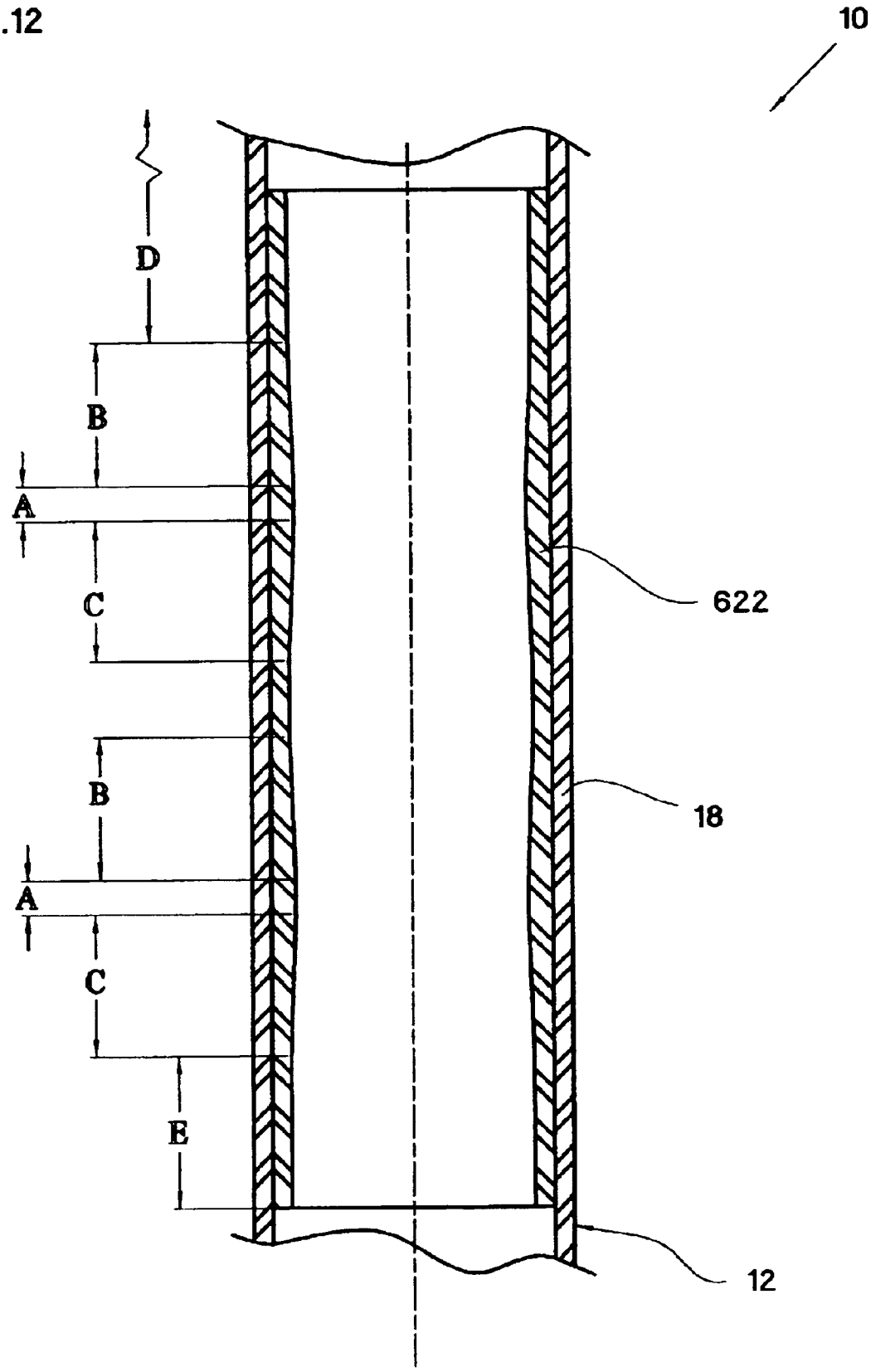
FIG. 12 is a longitudinal cross-sectional view of a portion of a bat and an insert in accordance with yet another alternative preferred embodiment of the present invention.

Referring to FIG. 12, another alternative preferred embodiment of the present invention is illustrated, in which an insert 622 is installed within, and coaxially aligned with, the hitting portion 18 of the bat 100. The insert 622 can include multiple variations in wall thickness along its length. In this manner the insert 622 can be formed at a greater thickness at particular locations along the hitting portion 18 of the frame 12 and at a reduced thickness at other locations along the hitting portion 18. The insert 622 is similar to the insert 22 and is positioned in the frame 12 in a manner similar to that of insert 22. This variable wall thickness construction with multiple thickness variations along the length of the insert enables the bat to be finely tuned to match a particular performance objective. FIG. 12 illustrates one particularly preferred embodiment wherein the width of the insert increases and decreases at multiple locations along the length of the insert. In this particularly preferred embodiment, the insert 622 includes multiple intermediate tubular regions (shown as item A), at least four tubular wall transition regions (shown as items B and C), proximal and distal end regions (shown as items D and E) and other regions having wall thickness similar to the proximal or distal end regions. In other particularly preferred embodiments, other combinations of wall thickness variations, configurations, and thicknesses are contemplated.

The insert 622 includes a proximal end, a distal end and an average thickness value. The wall thickness of the insert 622 varies along its length such that at least first and second separate portions of the insert 622 have thickness greater than the average thickness, and at least third and fourth separate portions of the insert 622 have a wall thickness below the average wall thickness value. For example, referring to FIG. 12, the portions of the insert 622 identified as item A have a wall thickness, which is greater than the average thickness of the insert 622, and the portions of the insert 622 identified as items D and E (and the portion between items C and B), each have a wall thickness, which is lower than the average wall thickness of the insert 622.

The insert 622 preferably has a generally uniform outside diameter along its length and an inside diameter that is variable along its length. Alternatively, the opposite configuration can be employed. The insert 622 is configured to move independently of the hitting portion 18 upon impact with a ball in a manner characteristic of a leaf spring.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A ball bat configured for impacting a ball, the bat comprising:

a substantially tubular frame extending along a longitudinal axis having a handle portion and a primary hitting portion; and a substantially tubular body coaxially aligned with the hitting portion of the frame, the body including a proximal end, a distal end, and first and second tubular wall transition regions, the first tubular wall transition region positioned closer to the proximal end than the second tubular wall transition region, the wall thickness of the first tubular wall transition region generally increasing along the longitudinal axis from a first position, generally near the proximal end, toward the distal end, and the wall thickness of the second tubular wall transition region generally increasing along the longitudinal axis from a second position, generally near the distal end, toward the proximal end, the body being configured to move independently with respect to the hitting portion of the frame upon impact with the ball.

2. The ball bat of claim 1, wherein the first and second tubular wall transition regions each have a length within the range of 0.25 to 7.0 inches.

3. The ball bat of claim 1, wherein the first and second tubular wall transition regions each have a length within the range of 0.50 to 5.0 inches.

4. The ball bat of claim 1, wherein the first and second tubular wall transition regions each have a length within the range of 2.0 to 4.0 inches.

5. The ball bat of claim 1, wherein the tubular body further includes an intermediate tubular region having generally uniform wall thickness and positioned between the first and second tubular wall transition regions.

6. The ball bat of claim 5, wherein the intermediate tubular region has a length within the range of 0.25 to 9.0 inches.

7. The ball bat of claim 5, wherein the intermediate tubular region has a length within the range of 0.1 to 5.0 inches.

8. The ball bat of claim 1, wherein the tubular body further includes a proximal tubular region and a distal tubular region, wherein the proximal tubular region is positioned adjacent the proximal end of the body, and wherein the distal tubular region is positioned adjacent the distal end of the body.

9. The ball bat of claim 8, wherein at least one of the proximal and distal tubular regions has a generally uniform wall thickness.

10. The ball bat of claim 1, wherein the difference in wall thickness from a first end of the first tubular wall transition region to a second end of the first tubular wall transition region is within the range of 0.003 to 0.040 inches, and the difference in wall thickness from a first end of the second tubular wall transition region to a second end of the second tubular wall transition region is within the range of 0.003 to 0.040 inches.

11. The ball bat of claim 10, the difference in wall thickness of the first tubular wall transition region is within the range of 0.005 to 0.015 inches, and wherein the difference in wall thickness of the second tubular wall transition region is within the range of 0.005 to 0.015 inches.

12. The ball bat of claim 10, the difference in wall thickness of at least one of the first and second tubular wall transition regions is within the range of 0.006 to 0.010 inches.

13. The ball bat of claim 1, wherein the wall thickness of the first tubular wall transition region generally increases linearly along the longitudinal axis from the first position, generally near the proximal end, toward the distal end.

14. The ball bat of claim 1, wherein the wall thickness of the second tubular wall transition region generally increases linearly along the longitudinal axis from the second position, generally near the distal end, toward the proximal end.

15. The ball bat of claim 1, wherein the wall thickness of the first tubular wall transition region generally increases non-linearly along the longitudinal axis from the first position, generally near the proximal end, toward the distal end.

16. The ball bat of claim 1, wherein the wall thickness of the second tubular wall transition region generally increases non-linearly along the longitudinal axis from the second position, generally near the distal end, toward the proximal end.

17. The ball bat of claim 1, wherein the wall thickness of the body is within the range of 0.025 to 0.090 inches.

18. The ball bat of claim 1, wherein the body is a one-piece unitary member.

19. The ball bat of claim 1, wherein the body is formed of two or more pieces, and wherein the two or more pieces are positioned in one of an end to end configuration, an overlapping configuration and a combination thereof.

20. The ball bat of claim 1, wherein the tubular body is positioned within the hitting portion of the tubular frame.

21. The ball bat of claim 20, wherein the body has inner and outer tubular surfaces, wherein the diameter of the inner tubular surface varies by at least 0.005 inches along its length, and wherein the diameter of the outer tubular surface is substantially uniform along its length.

22. The ball bat of claim 1, wherein the hitting portion of the tubular frame is positioned within the tubular body.

23. The ball bat of claim 22, wherein the body has inner and outer tubular surfaces, wherein the diameter of the inner tubular surface is substantially uniform along its length, and wherein the diameter of the outer tubular surface varies by at least 0.005 inches along its length.

24. The ball bat of claim 1, wherein the body further includes at least one longitudinally extending slit extending from the proximal end of the body toward the distal end of the body.

25. A ball bat configured for impacting a ball, the bat comprising:

a substantially tubular frame extending along a longitudinal axis having a handle portion and a primary hitting portion; and a substantially tubular body coaxially aligned with the hitting portion of the frame, the body including a proximal end, a distal end, a central region, and a distal tubular wall transition region, the distal tubular wall transition region positioned near the distal end of the body, the wall thickness of the central region being generally uniform along the longitudinal axis, the wall thickness of the distal tubular wall transition region generally increasing along the longitudinal axis from a first position, generally near the distal end, toward the proximal end, the body being configured to move independently with respect to the hitting portion of the frame upon impact with the ball.

26. The ball bat of claim 25, wherein the body further includes a proximal tubular wall transition region at a position proximal of the central region, and wherein the proximal wall transition region has a wall thickness that generally increases along the longitudinal axis from a second position, generally near the proximal end, toward the distal end.

27. The ball bat of claim 25, wherein the distal tubular wall transition region has a length within the range of 0.25 to 7.0 inches.

28. The ball bat of claim 25, wherein the distal tubular wall transition region has a length within the range of 0.50 to 5.0 inches.

29. The ball bat of claim 25, wherein the distal tubular wall transition region has a length within the range of 2.0 to 4.0 inches.

30. The ball bat of claim 25, wherein the generally uniform wall thickness of the central region varies by less than 0.003 inches along its length.

31. The ball bat of claim 25, wherein the central region has a length within the range of 0.25 to 9.0 inches.

32. The ball bat of claim 25, wherein the central region has a length within the range of 0.1 to 5.0 inches.

33. The ball bat of claim 25, wherein the tubular body further includes a proximal end tubular region and a distal end tubular region, wherein the proximal end tubular region is positioned adjacent the proximal end of the body, and wherein the distal end tubular region is positioned adjacent the distal end of the body.

34. The ball bat of claim 25, wherein the difference in wall thickness from a first end of the distal tubular wall transition region to a second end of the distal tubular wall transition region is within the range of 0.003 to 0.040 inches.

35. The ball bat of claim 34, the difference in wall thickness of the distal tubular wall transition region is within the range of 0.005 to 0.015 inches.

36. The ball bat of claim 34, the difference in wall thickness of the distal tubular wall transition regions is within the range of 0.006 to 0.010 inches.

37. The ball bat of claim 25, wherein the increase in wall thickness of the distal tubular wall transition region along the longitudinal axis from the first position generally near the distal end toward the proximal end, is linear, non-linear, stepped, staggered or a combination thereof.

38. The ball bat of claim 26, wherein the increase in wall thickness of the proximal tubular wall transition region along the longitudinal axis from the second position generally near the proximal end toward the distal end, is linear, non-linear, stepped, staggered or a combination thereof.

39. The ball bat of claim 25, wherein the wall thickness of the body is within the range of 0.025 to 0.090 inches.

40. The ball bat of claim 25, wherein the body is a one-piece unitary member.

41. The ball bat of claim 25, wherein the body is formed of two or more pieces, and wherein the two or more pieces are positioned in one of an end to end configuration, an overlapping configuration and a combination thereof.

42. The ball bat of claim 25, wherein the tubular body is positioned within the hitting portion of the tubular frame.

43. The ball bat of claim 42, wherein the body has inner and outer tubular surfaces, wherein the diameter of the inner tubular surface varies by at least 0.005 inches along its length, and wherein the diameter of the outer tubular surface is substantially uniform along its length.

44. The ball bat of claim 25, wherein the hitting portion of the tubular frame is positioned within the tubular body.

45. The ball bat of claim 44, wherein the body has inner and outer tubular surfaces, wherein the diameter of the inner tubular surface is substantially uniform along its length, and wherein the diameter of the outer tubular surface varies by at least 0.005 inches along its length.

46. The ball bat of claim 25, wherein the body further includes at least one longitudinally extending slit extending from the proximal end of the body toward the distal end of the body.

47. A ball bat performance-enhancing member, the ball bat having a substantially tubular frame extending along a longitudinal axis, and having a handle portion and a primary hitting portion, the bat being configured for impacting a ball, the performance-enhancing member comprising:

a substantially tubular body coaxially aligned with the hitting portion of the frame, the body including a proximal end, a distal end, and first and second tubular wall transition regions, the first tubular wall transition region positioned closer to the proximal end than the second tubular wall transition region, the wall thickness of the first tubular wall transition region generally increasing along the longitudinal axis from a first position, generally near the proximal end, toward the distal end, and the wall thickness of the second tubular wall transition region generally increasing along the longitudinal axis from a second position, generally near the distal end, toward the proximal end, the body being configured to move independently with respect to the hitting portion of the frame upon impact with the ball.

48. The ball bat performance-enhancing member of claim 47, wherein the first and second tubular wall transition regions each have a length within the range of 0.50 to 5.0 inches.

49. The ball bat performance-enhancing member of claim 47, wherein the first and second tubular wall transition regions each have a length within the range of 2.0 to 4.0 inches.

50. The ball bat performance-enhancing member of claim 47, wherein the tubular body further includes an intermediate tubular region having generally uniform wall thickness and positioned between the first and second tubular wall transition regions.

51. The ball bat performance-enhancing member of claim 50, wherein the intermediate tubular region has a length within the range of 0.1 to 5.0 inches.

52. The ball bat performance-enhancing member of claim 47, wherein the tubular body further includes a proximal tubular region and a distal tubular region, wherein the proximal tubular region is positioned adjacent the proximal end of the body, and wherein the distal tubular region is positioned adjacent the distal end of the body.

53. The ball bat performance-enhancing member of claim 47, wherein the difference in wall thickness from a first end of the first tubular wall transition region to a second end of the first tubular wall transition region is within the range of 0.003 to 0.015 inches, and the difference in wall thickness from a first end of the second tubular wall transition region to a second end of the second tubular wall transition region is within the range of 0.003 to 0.015 inches.

54. The ball bat performance-enhancing member of claim 47, wherein the increase in wall thickness of the first tubular wall transition region along the longitudinal axis from the first position generally near the proximal end toward the distal end, is linear, non-linear, stepped, staggered or a combination thereof.

55. The ball bat performance-enhancing member of claim 47, wherein the increase in wall thickness of the second tubular wall transition region along the longitudinal axis from the second position generally near the distal end toward the proximal end, is linear, non-linear, stepped, staggered or a combination thereof.

56. The ball bat performance-enhancing member of claim 47, wherein the body is a one-piece unitary member.

57. The ball bat performance-enhancing member of claim 47, wherein the body is formed of two or more pieces, and wherein the two or more pieces are positioned in one of an end to end configuration, an overlapping configuration and a combination thereof.

58. The ball bat performance-enhancing member of claim 47, wherein the tubular body is configured to be positioned within the hitting portion of the tubular frame.

59. The ball bat performance-enhancing member of claim 47, wherein the tubular body is configured to receive and surround at least a portion of the hitting portion of the tubular frame.

60. The ball bat performance-enhancing member of claim 47, wherein the body further includes at least one longitudinally extending slit extending from the proximal end of the body toward the distal end of the body.

* * * * *